US011590785B2

(12) United States Patent
Kurane

(10) Patent No.: US 11,590,785 B2
(45) Date of Patent: Feb. 28, 2023

(54) PRINTING APPARATUS AND ADJUSTMENT METHOD

(71) Applicant: SEIKO EPSON CORPORATION, Tokyo (JP)

(72) Inventor: Haruhisa Kurane, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 17/215,573

(22) Filed: Mar. 29, 2021

(65) Prior Publication Data

US 2021/0300097 A1 Sep. 30, 2021

(30) Foreign Application Priority Data

Mar. 30, 2020 (JP) ..... JP2020-059694

(51) Int. Cl.
*B41J 29/393* (2006.01)

(52) U.S. Cl.
CPC ..... *B41J 29/393* (2013.01); *B41J 2029/3935* (2013.01); *B41J 2203/01* (2020.08)

(58) Field of Classification Search
CPC ..... G06K 15/027; B41J 29/393; B41J 2029/3935; B41J 2203/01; H04N 1/00034; H04N 1/00045
See application file for complete search history.

(56) References Cited

U.S. PATENT DOCUMENTS

2002/0140757 A1* 10/2002 Tullis ..... B41J 29/393 347/19
2003/0112283 A1* 6/2003 Ward ..... B41J 2/2135 347/5
2018/0201015 A1* 7/2018 Hochi ..... B41J 19/145
2018/0236799 A1 8/2018 Kanai

FOREIGN PATENT DOCUMENTS

JP 2018-134778 8/2018

* cited by examiner

*Primary Examiner* — Julian D Huffman
(74) *Attorney, Agent, or Firm* — Workman Nydegger

(57) ABSTRACT

A printing apparatus includes an imaging apparatus, a carriage, and a processing section. A sensor in the imaging apparatus has a plurality of pixels placed in a row direction and a column direction in the form of a matrix. The imaging apparatus is disposed in the carriage so that the row direction of the sensor and the direction in which the plurality of nozzles constituting each nozzle row are placed become parallel. The processing section causes ink to be discharged from a nozzle row to be adjusted to print a test pattern. By using a two-dimensional scale as a reference in detection of landing deviation, the processing section detects the landing deviation caused by the nozzle row to be adjusted, according to the imaged test pattern.

9 Claims, 14 Drawing Sheets

PRINTING APPARATUS AND ADJUSTMENT METHOD

The present application is based on, and claims priority from JP Application Serial Number 2020-059694, filed Mar. 30, 2020, the disclosure of which is hereby incorporated by reference herein in its entirety.

BACKGROUND

1. Technical Field

The present disclosure relates to a printing apparatus, an adjustment method, and the like.

2. Related Art

In a printing apparatus that performs printing by discharging ink from nozzles provided in a head, error in head attachment causes a landing position of ink to deviate from an ideal position. JP-A-2018-134778 discloses a method of detecting this type of landing deviation. In JP-A-2018-134778, a reference head and a head to be adjusted, which is different from the reference head, are determined. Test patterns are printed at different pitches between reference nozzles in the reference head and nozzles to be adjusted in the head to be adjusted. The printed test patterns are imaged, after which landing deviation caused by the head to be adjusted is detected from the imaged test patterns.

In JP-A-2018-134778 above, one of a plurality of heads is determined as the reference head. Landing deviation caused by another head, which is to be adjusted, is detected with reference to landing positions of the reference head. When the head to be adjusted causes a problem, it suffices to replace the head to be adjusted with a new head to be adjusted and detect again landing deviation caused by the new head to be adjusted. Since the reference head may also be replaced due to a problem in it, however, landing deviation is desirably detectable by a comparison with a reference other than heads.

SUMMARY

One aspect of the present disclosure relates to a printing apparatus that includes a print head that has a plurality of nozzle rows, each of which is composed of a plurality of nozzles, an imaging apparatus that includes an area sensor and a lens, a carriage in which the print head and the imaging apparatus are mounted, and a processing section that prints a test pattern by using the print head, causes the imaging apparatus to image the test pattern, acquires the imaged test pattern, and according to the imaged test pattern, detects landing deviation of ink discharged from the plurality of nozzles. The area sensor has a matrix of a plurality of pixels placed in a row direction and a column direction. The imaging apparatus is disposed in the carriage so that the row direction of the area sensor and the direction in which the plurality of nozzles constituting each nozzle row are placed become parallel. The processing section causes ink to be discharged from a nozzle row to be adjusted, the nozzle row being included in the plurality of nozzles rows, to print the test pattern, after which by using a virtual two-dimensional scale as a reference in detection of landing deviation, the virtual two-dimensional scale being a scale in which the row direction of the area sensor is a Y-axis direction and the column direction of the area sensor is an X-axis direction, the processing section detects the landing deviation caused by the nozzle row to be adjusted, according to the imaged test pattern.

Another aspect of the present disclosure relates to an adjustment method of adjusting landing deviation in a printing apparatus that includes a print head that has a plurality of nozzle rows, each of which is composed of a plurality of nozzles, an imaging apparatus that includes an area sensor and a lens, and a carriage in which the print head and the imaging apparatus are mounted. The adjustment method comprising: printing a test pattern by using the print head to cause ink to be discharged from a nozzle row to be adjusted, the nozzle row being included in the plurality of nozzle rows; causing the imaging apparatus, in which the area sensor has a matrix of a plurality of pixels placed in a row direction and a column direction and which is disposed so that the row direction of the area sensor and the direction in which the plurality of nozzles constituting each nozzle row are placed become parallel, to image the test pattern and acquire the imaged test pattern; detecting, by using a virtual two-dimensional scale as a reference in detection of landing deviation, the virtual two-dimensional scale being a scale in which the row direction of the area sensor is a Y-axis direction and the column direction of the area sensor is an X-axis direction, the landing deviation of ink discharged from the plurality of nozzles in the nozzle row to be adjusted, according to the imaged test pattern; and adjusting the landing deviation according to the landing deviation.

DESCRIPTION OF EXEMPLARY EMBODIMENTS

A preferred embodiment of the present disclosure will be described below in detail. This embodiment described below does not unreasonably restrict the contents described in the scope of claims. All of the structures described in this embodiment are not always essential structural requirements.

1. Printing Apparatus

Figure 1:
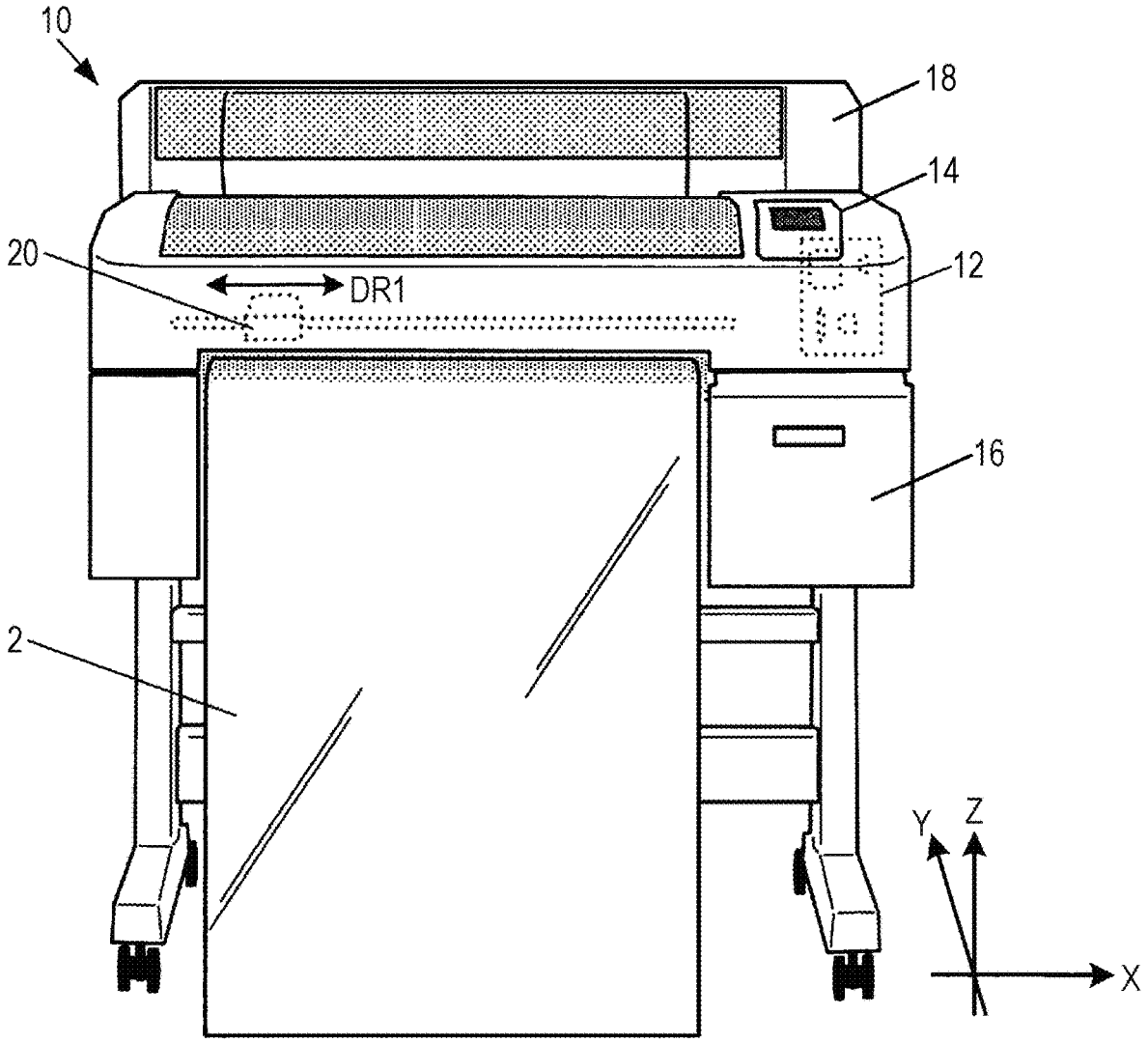
FIG. 1 is a front view of a printing apparatus.

FIG. 1 is a front view of a printing apparatus 10 in this embodiment. The printing apparatus 10 is an ink jet printer that forms an image on a print medium 2 according to image data, which is print data, by discharging droplets of an ink such as a dye ink or a pigment ink to the print medium 2. Specifically, the printing apparatus 10 prints a color image on the print medium 2 according to image data in colors such as red, green, and blue (RGB). Image data is supplied from an external host apparatus to the printing apparatus 10. The print medium 2 is a sheet-like medium. Types of the print medium 2 include paper media and film media. Paper media include cast-coated paper, art paper, and coated paper. Film media include synthetic paper, polyethylene terephthalate (PET) films, and poly-propylene (PP) films. The print medium 2 may be made of a fabric or the like.

The printing apparatus 10 has a control circuit board 12, a manipulation panel 14, an ink storage section 16, a supply section 18, and a carriage 20. The control circuit board 12 controls the operations of the printing apparatus 10 in an integrated manner. A processor, a memory that stores various types of information, and the like are mounted on the control circuit board 12. The manipulation panel 14 is used by the user to make settings for the printing apparatus 10 and enter an input. A plurality of storage units are disposed in the ink storage section 16. In each storage unit, ink in one of a plurality of colors including black, yellow, magenta, cyan, and the like is stored. The print medium 2 is loaded into the supply section 18 in the form of a roll in which the print medium 2 is wound over and over in a cylindrical form. The printing apparatus 10 performs printing by ejecting ink, which a type of liquid, to the print medium 2 while moving the carriage 20 along a main scanning direction DR1 under control of the control circuit board 12. The main scanning direction DR1 is also referred to as a raster direction. This embodiment will be described by mainly taking, as an example, a case in which the printing apparatus 10 is a large format printer (LFP) that performs serial printing on, for example, a print medium 2 in the A2 size or larger. However, the printing apparatus 10 may be a medium-format or small-format ink jet printing apparatus.

In FIG. 1, the X-axis direction, which is along the X axis, is the direction along the main scanning direction DR1. The X-axis direction is also the right and left direction of the printing apparatus 10 in FIG. 1. The X-axis direction matches the column direction of an area sensor 41, which will be described later. The Y-axis direction, which is along the Y axis, is the direction in which the print medium 2 is transported. The Y-axis direction is also the front/rear direction of the printing apparatus 10. The Y-axis direction matches a sub-scanning direction DR2, which will be described later, indicated in FIG. 3, and also matches the row direction of the area sensor 41, which will be described later. The Z-axis direction, which is along the Z axis, is the up-and-down direction, which is the vertical direction. The Z-axis direction is orthogonal to the X axis and Y axis.

Figure 2:
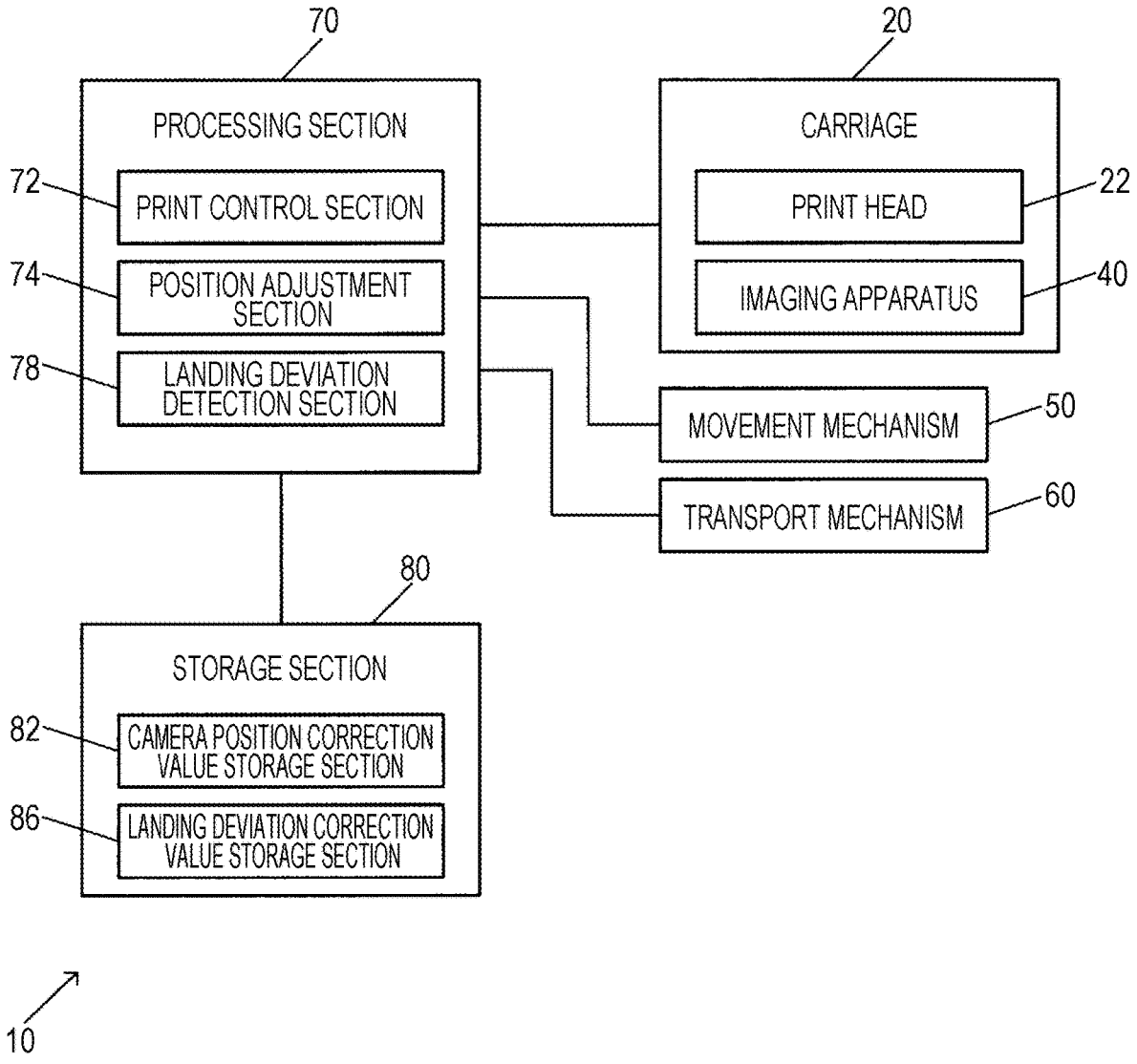
FIG. 2 is a block diagram illustrating an example of the structure of the printing apparatus.
Figure 3:
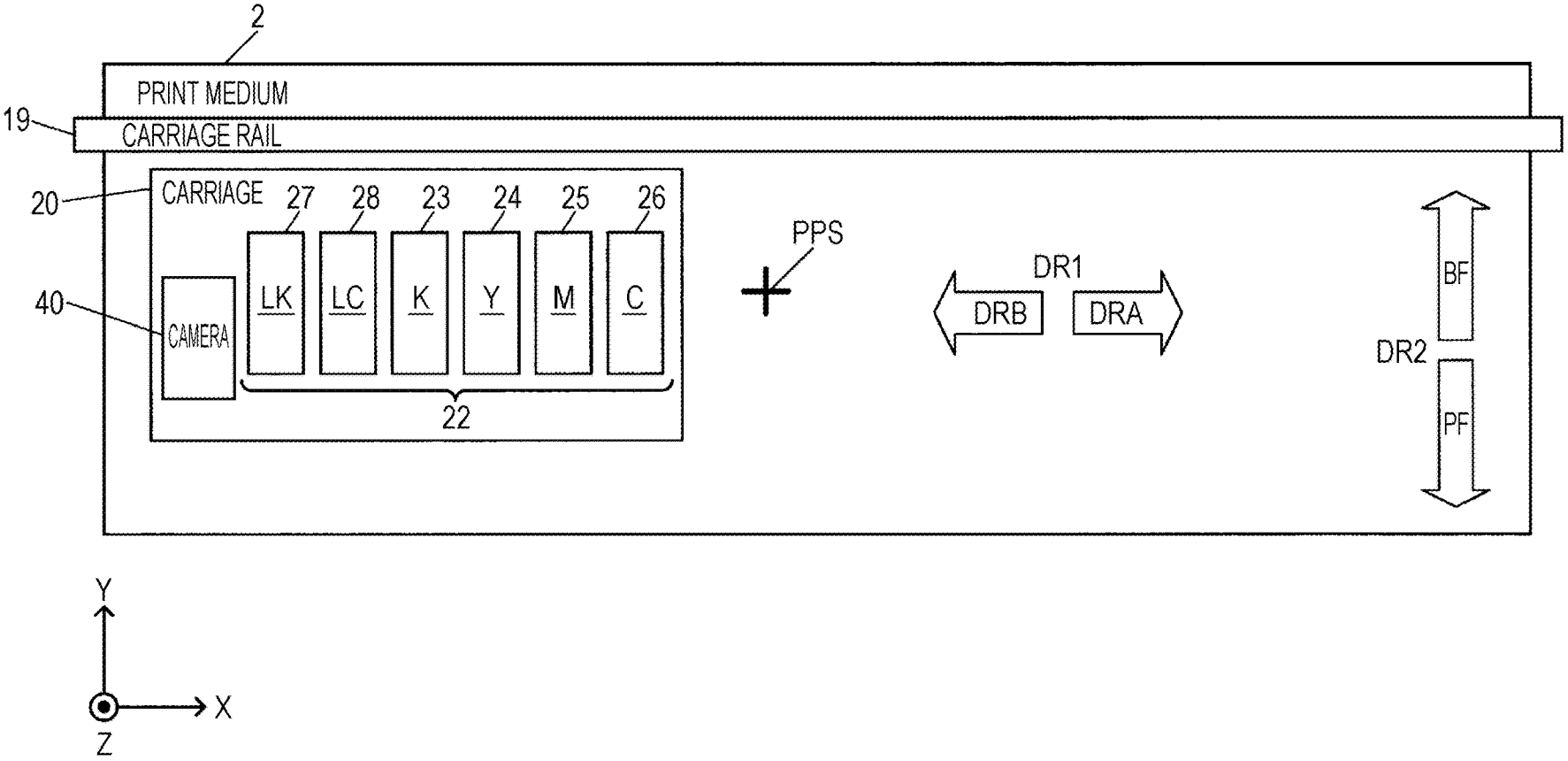
FIG. 3 is a plan view schematically illustrating the layout of a carriage, an imaging apparatus, and a position adjustment pattern.

FIG. 2 is a block diagram illustrating an example of the structure of the printing apparatus 10. FIG. 3 is a plan view schematically illustrating the layout of the carriage 20, an imaging apparatus 40, and a position adjustment pattern PPS. Besides the carriage 20 and imaging apparatus 40, the printing apparatus 10 also includes a movement mechanism 50, a transport mechanism 60, a processing section 70, and a storage section 80. A variation in which some of these constituent elements are omitted can also be practiced.

The carriage 20 moves with a print head 22 mounted in the carriage 20, the print head 22 discharging ink. Specifically, the carriage 20 is accommodated in the main body of the printing apparatus 10 in a state in which the carriage 20 can reciprocally move along the main scanning direction DR1 in FIG. 3, and moves along the main scanning direction DR1 with the print head 22 mounted in the carriage 20. When the print head 22 mounted in the carriage 20, which moves along the main scanning direction DR1 as described above, discharges ink, printing is performed on the print medium 2. The +X direction of the main scanning direction DR1 will be denoted DRA, and the −X direction of the main scanning direction DR1 will be denoted DRB. In the description below, it will be assumed that when the print head 22 discharges ink while the carriage 20 moves in the direction DRA, printing is performed.

The print head 22 is composed of a plurality of head units 23, 24, 25, 26, 27, and 28 as illustrated in FIG. 3. Ink in one color is discharged from each head unit. Specifically, inks in black (K), yellow (Y), magenta (M), cyan (C), light black (LK), and light cyan (LC) are supplied from the relevant storage units in the ink storage section 16 in FIG. 1 through tubes (not illustrated) to the head units 23, 24, 25, 26, 27, and 28, respectively, after they discharge droplets of the inks in these colors. Each of the head units 23, 24, 25, 26, 27, and 28 is a single head chip or is composed of a plurality of head chips. Each head chip has a nozzle row composed of a plurality of nozzles aligned along the Y-axis direction. Specifically, each head chip has a discharge surface that have holes and on which a plurality of nozzles that can discharge ink droplets are aligned. Inks in colors are discharged from the plurality of nozzles on the discharge surface. Thus, a color image can be printed on the print medium 2.

The layout of the head units 23, 24, 25, 26, 27, and 28 in FIG. 3 is just schematic. Various layouts of these head units are possible. For example, although, in FIG. 3, one head unit is provided for each color, a plurality of head units may be provided for each color or each head unit may be composed of head chips in a plurality of colors. Alternatively, although, in FIG. 3, a plurality of head units are aligned along the X-axis direction, a plurality of head units may be two-dimensionally arranged in an XY plane.

The imaging apparatus 40, which is mounted in the carriage 20, can take a picture of an image printed on the print medium 2 by the print head 22. The imaging apparatus 40 includes an optical system such as a lens unit and also includes an area sensor 41 such as complementary metal-oxide-semiconductor (CMOS) sensor or a charge-coupled device (CCD). The imaging apparatus 40 may include a light source such as a light-emitting diode (LED) light source. The imaging apparatus 40 is also referred to as a camera.

The movement mechanism 50 moves the carriage 20 along the main scanning direction DR1. The movement mechanism 50, which is a movement device, includes a movement restricting member, such as a carriage rail 19, that restricts the movement of the carriage 20, and also includes a driving member for carriage movement. The driving member has a CR motor for carriage movement and a motor driver that drives the CR motor. The movement mechanism 50 moves the carriage 20 along the carriage rail 19 by using the driving member for carriage movement. Thus, the carriage 20 moves along the main scanning direction DR1.

The transport mechanism 60 transports the print medium 2 along the sub-scanning direction DR2 indicated in FIG. 3. The transport mechanism 60, which is a transport device, includes a transport member, such as a transport roller, that transports the print medium 2, and also includes a driving member for transport. The driving member has a transport motor that rotates the transport roller, and also has a motor driver that drives the transport motor. The transport mechanism 60 rotates the transport roller by using the driving member for transport to transport, in the sub-scanning direction DR2, the print medium 2, which is wound over and over in the supply section 18 in the form of a roll. In FIG. 3, the forward direction in transport of the print medium 2 is taken as a feed direction PF, and the opposite direction in transport is taken as a back feed direction BF. The feed direction PF is toward the downstream in the transport direction, which is the sub-scanning direction DR2. The back feed direction BF is toward the upstream in the transport direction. The feed direction PF is toward the negative side of the Y axis. The back feed direction BF is toward the positive side of the Y axis. The transport mechanism 60 transports the print medium 2 from the upstream in the transport direction, which is the sub-scanning direction DR2, toward the downstream.

The processing section 70 performs control in printing of an image on the print medium 2. The processing section 70 includes a print control section 72 that performs print control, a position adjustment section 74 that controls position adjustment, and a landing deviation detection section 78 that detects landing deviation. The print control section 72 controls ink discharging from the print head 22, movement of the carriage 20 by the movement mechanism 50, and transport of the print medium 2 by the transport mechanism 60. The print control section 72 also controls the whole of the printing apparatus 10, photography by the imaging apparatus 40, and the like. The position adjustment section 74 controls position adjustment in a photography area, which will be described later, for the imaging apparatus 40. The landing deviation detection section 78 detects landing deviation caused by a nozzle row according to an imaged test pattern, as described later. The processing section 70, which is a controller, can be implemented by, for example, a processor mounted on the control circuit board 12 in FIG. 1. The processor can be implemented by, for example, a central processing unit (CPU), a digital signal processor (DSP), or a control integrated circuit (IC). A control IC, which is an integrated circuit device referred to as an application-specific integrated circuit (ASIC), can be implemented by automatic placement and routing performed by, for example, a gate array.

In this embodiment, the term landing refers to a dot formed when an ink droplet discharged from a nozzle adheres to the print medium 2. Alternatively, the term landing may be used to represent arrival of an ink droplet discharged from a nozzle to the print medium 2. The term landing deviation refers to positional deviation of a dot, that is, deviation of a position at which an ink droplet arrived at the print medium 2.

The storage section 80 stores various types of information. Specifically, the storage section 80 stores information used in execution of various types of control and processing in the printing apparatus 10. In this embodiment, the storage section 80 includes a camera position correction value storage section 82 and a landing deviation correction value storage section 86. The landing deviation correction value storage section 86 stores a landing deviation correction value obtained from the amount of landing deviation detected by the landing deviation detection section 78. The print control section 72 corrects landing deviation according to the landing deviation correction value. Specifically, the landing deviation correction value can include a discharge timing correction value and an image shift value. When the print control section 72 corrects a discharge timing according to the landing deviation correction value and shifts a pixel position in print data according to the image shift value, the print control section 72 performs print correction so that landing deviation is cancelled. The camera position correction value storage section 82 stores a correction value for the amount of movement by the movement mechanism 50 as a first correction value for position adjustment of the photography area for the imaging apparatus 40. The camera position correction value storage section 82 also stores a correction value for the amount of transport by the transport mechanism 60 as a second correction value for position adjustment of the photography area. To adjust the position of the photography area for the imaging apparatus 40, the amount of movement by the movement mechanism 50 is controlled according to the first correction value and the amount of transport by the transport mechanism 60 is controlled according to the second correction value. The storage section 80 can be implemented by a memory mounted on the control circuit board 12 in FIG. 1. The memory is, for example, a semiconductor memory. Specifically, the memory is a non-volatile memory. A non-volatile memory can be implemented by, for example, an electrically erasable programmable read-only memory (EEPROM) or a one time programmable (OTP) ROM in which a floating gate avalanche injection MOS (FAMOS) or the like is used.

Figure 4:
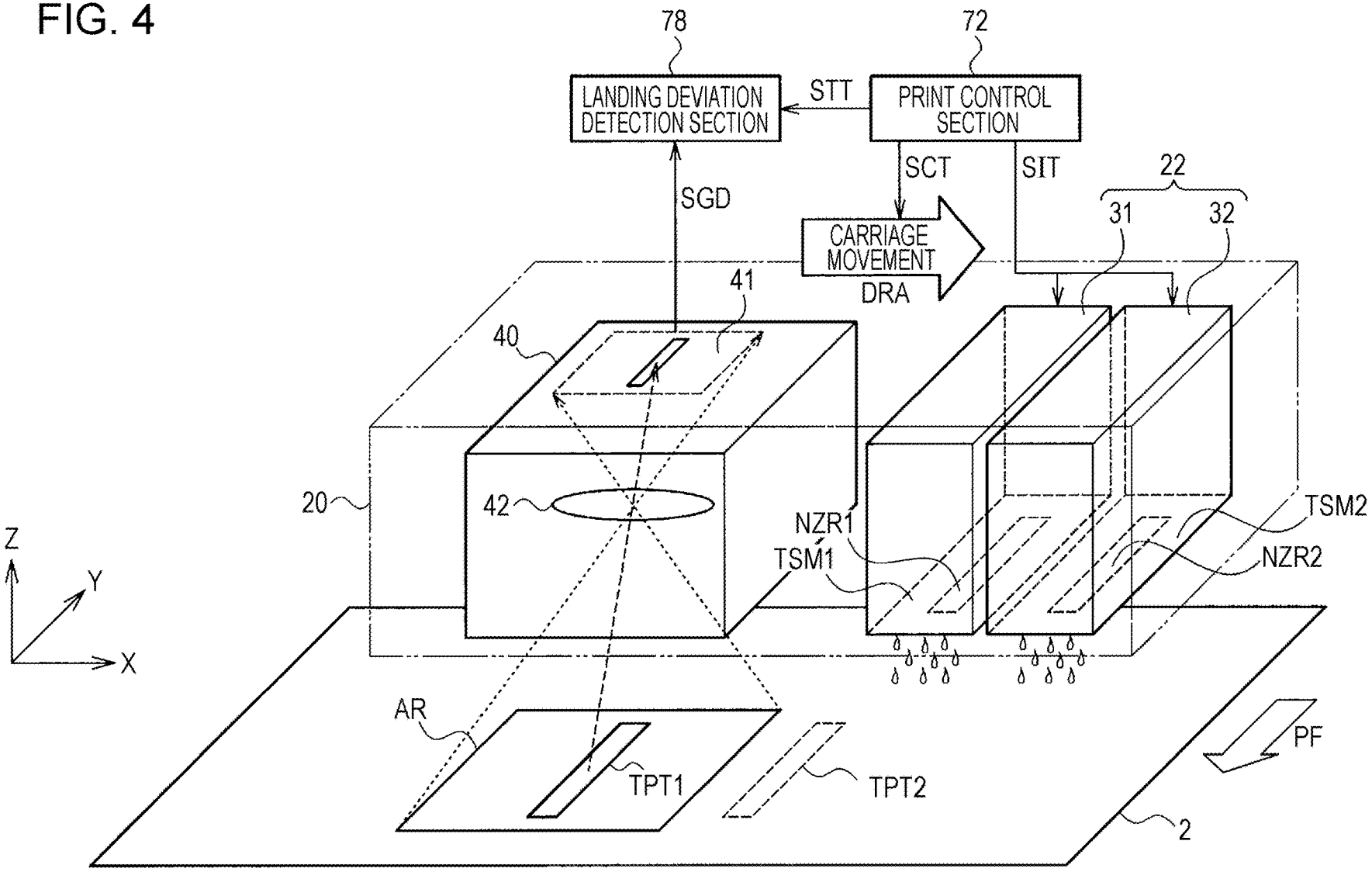
FIG. 4 is a perspective view of the printing apparatus, illustrating how a test pattern in detection of landing deviation is printed and how the test pattern is photographed.

FIG. 4 is a perspective view of the printing apparatus 10, illustrating how a test pattern in detection of landing deviation is printed and how the test pattern is photographed. In FIG. 4, only part of the constituent elements described with reference to FIGS. 1 to 3 is illustrated. FIG. 4 illustrates a case in which the print head 22 has two head units 31 and 32.

First, landing deviation of ink due to error in attachment of the head units 31 and 32 will be described with reference to FIG. 4. The head unit 31 has a discharge surface TSM1 on which a nozzle row NZR1 is provided. The head unit 32 has a discharge surface TSM2 on which a nozzle row NZR2 is provided.

Landing deviation of ink is caused by error in attachment of the head units 31 and 32 to the carriage 20. Attachment error that causes this type of landing deviation is classified into two types, positional deviation and rotational deviation of the nozzle rows NZR1 and NRZ2. In positional deviation, the nozzle row NZR1 or NZR2 deviates from its design position in the X-axis direction, Y-axis direction, or Z-axis direction. The landing position of ink on the print medium 2 deviates by the amount by the position of the nozzle row NZR1 or NZR2 deviates. In rotational deviation, the nozzle row NZR1 or NZR2, which is ideally parallel to the Y axis, becomes non-parallel to the Y axis. Due to rotational deviation of the nozzle row NZR1 or NZR2, a row of landings of ink on the print medium 2 becomes non-parallel to the Y axis.

Rotational deviation includes first rotational deviation around a rotational axis parallel to the Z axis and second rotational deviation around a rotational axis parallel to the X axis. The first rotational deviation is rotational deviation in a plane parallel to a surface of the print medium 2, that is, parallel to an XY plane. In the first rotational deviation, a row of landings from the nozzle row NZR1 or NZR2 is inclined on the print medium 2 with respect to the Y axis. The second rotational deviation is rotational deviation in which a surface of the print medium 2, that is, an XY plane, and the discharge surface TSM1 or TSM2 becomes non-parallel. When the second rotational deviation occurs, a distance from a nozzle to the print medium 2 differs between the +Y side and −Y side of the nozzle row NZR1 or NZR2.

A plurality of nozzles constituting each nozzle row concurrently discharge ink. When a distance from a nozzle to the print medium 2 differs between the +Y side and −Y side, therefore, a time taken by ink to land on the print medium 2 differs. Since ink is discharged while the carriage 20 moves in the main scanning direction DRA, the landing position deviates in the X-axis direction due to the difference in distance between the +Y side and −Y side of the nozzle row NZR1 or NZR2. Specifically, the longer the distance between the nozzle and the print medium 2 is, the more the landing position deviates in the +X direction. The second rotational deviation appears on the print medium 2 as an inclination of a row of landings with respect to the Y axis, as in the first rotational deviation.

In print correction, the print control section 72 corrects the positional deviation of the nozzle row NZR1 or NZR2 according to the discharge timing correction value described above, and corrects the rotational deviation of the nozzle row NZR1 or NZR2 according to the image shift value described above, for example.

To perform this type of print correction, landing deviation needs to be detected. In related art, one of a plurality of head units provided in the carriage 20 has been used as a reference and landing deviation caused by another head unit has been detected as in JP-A-2018-134778. However, any of the plurality of head units in the carriage 20 may be replaced due to a problem or the like. In reality, therefore, any one head unit is not a special reference. A problem with related art is that when the head unit determined as a reference in landing deviation is replaced due to a problem or the like, the detection reference in landing deviation varies.

Figure 5:
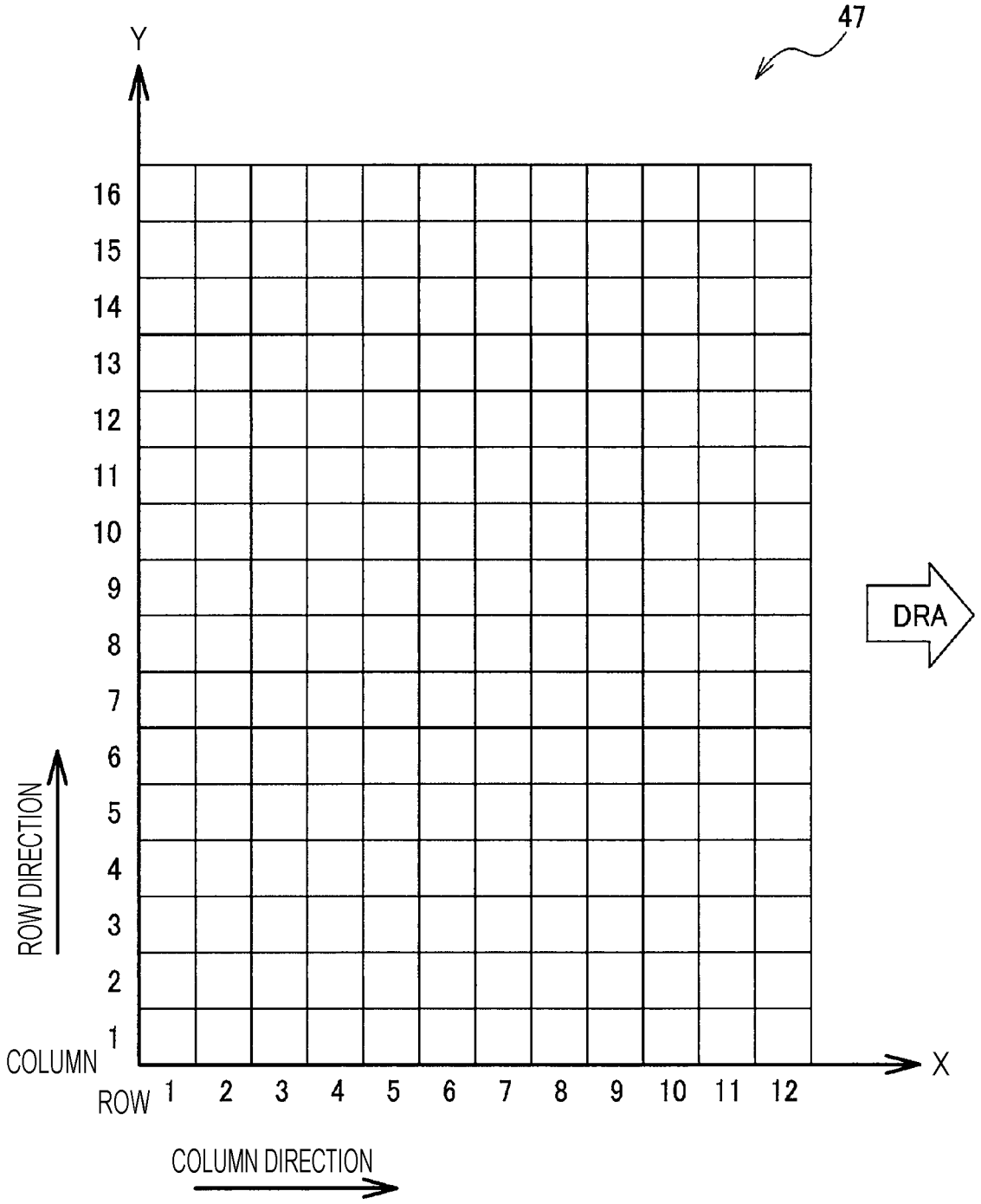
FIG. 5 illustrates a virtual two-dimensional scale.

In this embodiment, therefore, the print control section 72 uses the print head 22 to print a test pattern TPT1. The landing deviation detection section 78 causes the imaging apparatus 40 to image the test pattern TPT1, obtains an imaged test pattern, and detects landing deviation of ink discharged from a plurality of nozzles according to the imaged test pattern. The imaging apparatus 40 also includes a lens 42 besides the area sensor 41. The area sensor 41 has a plurality of pixels PX placed in a row direction and a column direction in the form of a matrix as illustrated in FIG. 5. The imaging apparatus 40 is disposed in the carriage 20 so that the row direction of the area sensor 41 and the direction in which a plurality of nozzles constituting each nozzle row are placed become parallel. A scale in which the row direction of the area sensor 41 is the Y-axis direction and the column direction of the area sensor 41 is the X-axis direction is taken as a two-dimensional scale 47, which is a virtual scale. The print control section 72 causes ink to be discharged from the nozzle row NZR1 to be adjusted, which is one of a plurality of nozzle rows NZR1 and NZR2, to print the test pattern TPT1. By using the two-dimensional scale 47 as a reference in detection of landing deviation, the landing deviation detection section 78 detects landing deviation caused by the nozzle row NZR1 to be adjusted, according to the imaged test pattern.

An example in which the nozzle row NZR1 is used as the nozzle row to be adjusted will be described below. However, the nozzle row to be adjusted may be any one of the plurality of nozzles rows NZR1 and NZR2. When the nozzle row NZR2 is used as the nozzle row to be adjusted, the test pattern printed by using the nozzle row to be adjusted is a test pattern TPT2.

When the two-dimensional scale 47 is used as a reference, this means that coordinates on the two-dimensional scale 47 themselves are used as a reference. Specifically, an ideal landing reference independent of the landing positions of the nozzle rows NZR1 and NZR2 is set on the two-dimensional scale 47. The landing reference on the two-dimensional scale 47 is used as a reference in landing deviation.

According to this embodiment, the two-dimensional scale 47, the Y axis and X axis of which are stipulated by the row direction and column direction of the area sensor 41, is used as a reference in landing deviation of ink. That is, since a reference other than the plurality of head units 31 and 32 mounted in the carriage 20 is used, the plurality of head units 31 and 32 are equally handled in landing deviation detection. Therefore, even when any one of the plurality of head units 31 and 32 is replaced, landing deviation can still be detected by using the two-dimensional scale 47 as a reference. When the two-dimensional scale 47 is used as a reference, it is also possible to obtain the absolute value of landing deviation with respect to the ideal state on the two-dimensional scale 47 as the number of pixels in the X-axis direction instead of the difference between head units.

Specifically, the landing deviation detection section 78 detects landing deviation by comparing the imaged test pattern with an ideal image pattern for the landing positions, on the two-dimensional scale 47, of the nozzle row NZR1 to be adjusted.

The ideal image pattern is information indicating ideal positions of landing on the two-dimensional scale 47. Examples of the ideal image pattern include an image in which dots are placed at ideal positions for landing, coordinates indicating ideal positions for landing, and lines indicating the positions of rows for ideal landing. The ideal image pattern is not set by taking any one of the head units 31 and 32 as a reference, but is set according to, for example, a value that is ideal from the viewpoint of design.

Thus, when the imaged test pattern is compared with the ideal image pattern defined on the two-dimensional scale 47, it is possible to detect landing deviation caused by each nozzle row with reference to the two-dimensional scale 47.

The method in this embodiment will be described below in detail. The print control section 72 controls the movement mechanism 50 in response to a carriage canning signal SCI and moves the carriage 20 in the main scanning direction DRA, as illustrated in FIG. 4. The storage section 80 stores print data of the test patterns TPT1 and TPT2. The print control section 72 reads out the print data of the test patterns TPT1 and TPT2 from the storage section 80, controls the head units 31 and 32 in response to a discharge timing signal SIT, and causes the test patterns TPT1 and TPT2 to be printed at predetermined times.

The lens 42 in the imaging apparatus 40 causes the area sensor 41 to form a photography area AR on the print medium 2. The print control section 72 outputs a capturing timing signal STT to the landing deviation detection section 78 at a time when a predetermined positional relationship is established between the test patterns TPT1 and TPT2 and the photography area AR for the imaging apparatus 40. This positional relationship is predetermined according to design values for the distances between the imaging apparatus 40 and the head units 31 and 32 so that the test patterns TPT1 and TPT2 are formed at a central portion of the photography area AR. At a time when the landing deviation detection section 78 is commanded by the capturing timing signal STT, the landing deviation detection section 78 causes the imaging apparatus 40 to image the photography area AR, and acquires image data SGD including the test patterns TPT1 and TPT2. The test patterns TPT1 and TPT2 included in this image will be referred to as an imaged test pattern. The landing deviation detection section 78 compares the imaged test pattern with the ideal landing position on the two-dimensional scale 47, detects landing deviation, and stores a landing deviation correction value in the storage section 80 according to the result.

The area sensor 41 has a pixel array in which pixels PX are placed in 12 rows and 16 columns as illustrated in FIG. 5. The pixel array may have any size. Pixels PX in one row are equivalent to one horizontal scanning line. That is, the row direction matches the horizontal scanning direction. Pixels PX in one column are aligned along the vertical scanning direction. The column direction matches the vertical scanning direction. In this embodiment, the pixel array in the area sensor 41 is used as the two-dimensional scale 47, which is a reference in landing deviation detection. The row direction of the area sensor 41 is the X-axis direction of the two-dimensional scale 47, and is parallel to the main scanning direction DRA. The column direction of the area sensor 41 is the Y-axis direction of the two-dimensional scale 47, and is orthogonal to the X-axis direction. An XY plane of the two-dimensional scale 47 is parallel to a surface of the print medium 2. The origin of the two-dimensional scale 47 is, for example, the pixel in row 1 and column 1 or the pixel at the center of the pixel array. When, for example, the pixel in row 1 and column 1 is the origin, an X coordinate on the two-dimensional scale 47 is a row number and a Y coordinate is a column number. Setting error in the imaging apparatus 40 is corrected by camera position correction, which will be described later.

Figure 6:
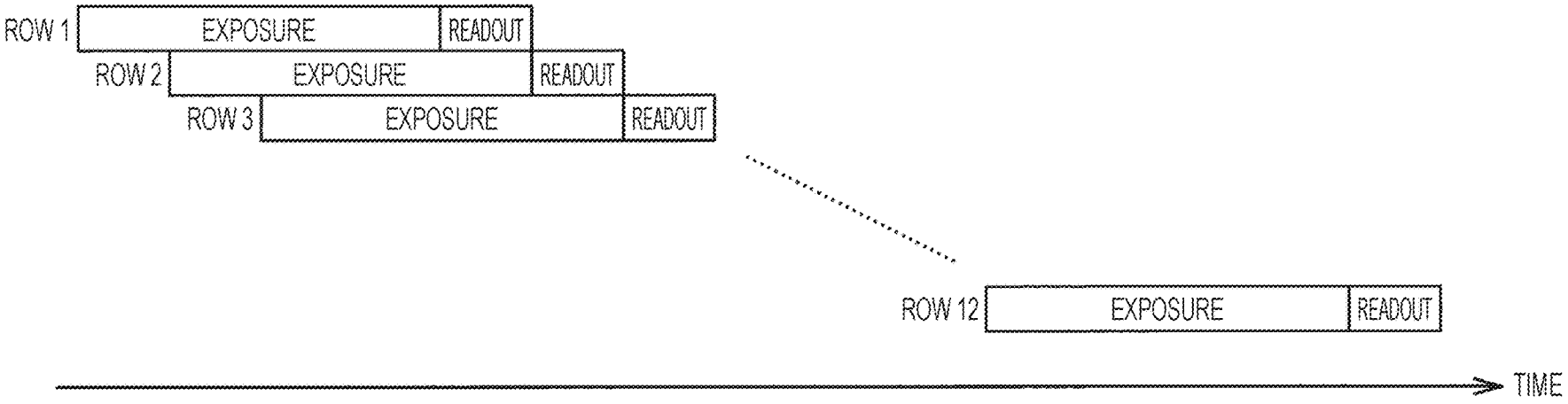
FIG. 6 illustrates how an area sensor performs an exposure operation.

FIG. 6 illustrates how the area sensor 41 performs an exposure operation. The area sensor 41 can include a pixel array, a row selector, and a sense amplifier circuit. The row selector starts exposure of row 1, row 2, row 3, . . . , and row 12 of the pixel array in succession, and stops the exposure in succession. All rows are exposed for the same time. Time to start exposure is shifted in succession by an amount equal to a time taken to read out pixel data. The row selector selects the row for which exposure has been stopped. The amplifier circuit reads out all pixel data for the selected row at once. When the reading of row 1 is completed, row 2, row 3, . . . , and row 12 are read out in succession.

According to this embodiment, the area sensor 41 is a sensor that reads out all of a plurality of pixel data items in the row direction at once and outputs the read-out pixel data. That is, the area sensor 41 performs exposure by a rolling shutter method.

In a rolling shutter method, rows are read out at different times. When the imaging apparatus 40 and a subject relatively move, therefore, rolling shutter distortion may occur. In this embodiment, the test pattern TPT1 or TPT2 is imaged by the imaging apparatus 40 while the carriage 20 is moved in the main scanning direction DRA or after the carriage 20 is moved to the position of the test pattern TPT1 or TPT2 and is then stopped. However, since the imaging apparatus 40 is set so that the row direction of the area sensor 41 is orthogonal to the main scanning direction DRA, the effect of rolling shutter distortion is less likely to occur. That is, since the nozzle rows NZR1 and NZR2 are orthogonal to the main scanning direction DRA, the rows of landings of ink are orthogonal to the main scanning direction DRA. Therefore, the row of landings of ink is parallel to the row direction of the area sensor 41, and the landings in the row are thereby imaged concurrently, making the effect of rolling shutter distortion less likely to occur.

2. Processing Flow

Figure 7:
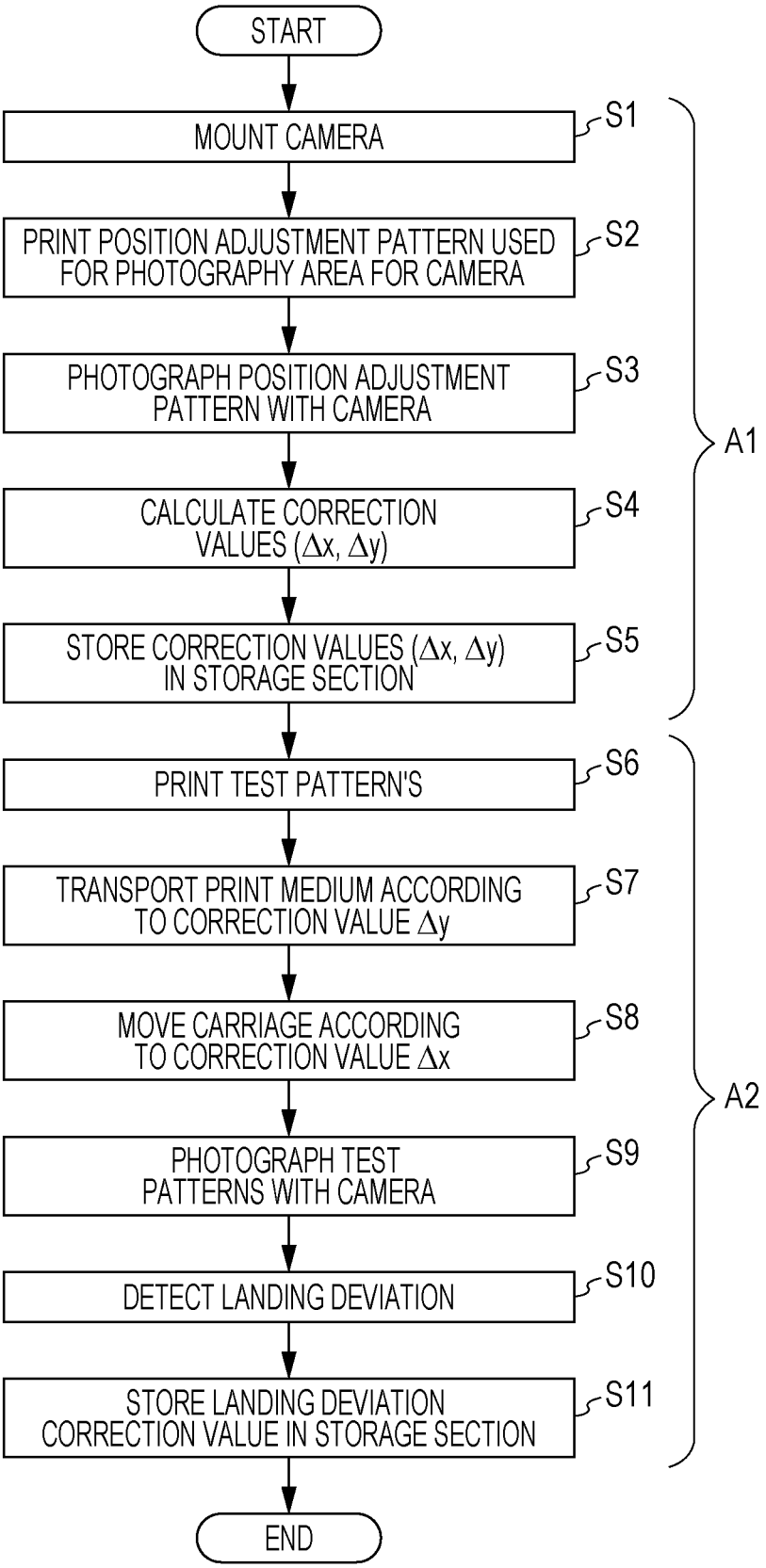
FIG. 7 is a flowchart illustrating an example of processing in detail.

FIG. 7 is a flowchart illustrating an example of processing in this embodiment in detail. A1 in FIG. 7 is a flow of processing in which the imaging apparatus 40 is mounted in the carriage 20 and a correction value for the mounting position is calculated and is recorded.

In step S1, the imaging apparatus 40 for use for automatic adjustment is mounted in the carriage 20. This mounting of the imaging apparatus 40 is performed by a worker or a work robot during, for example, assembling of the printing apparatus 10 or replacement of the print head 22. The imaging apparatus 40 is mounted at a position upstream of the print head 22 in the carriage 20 in the main scanning direction DRA, as illustrated in FIG. 3.

Figure 8:
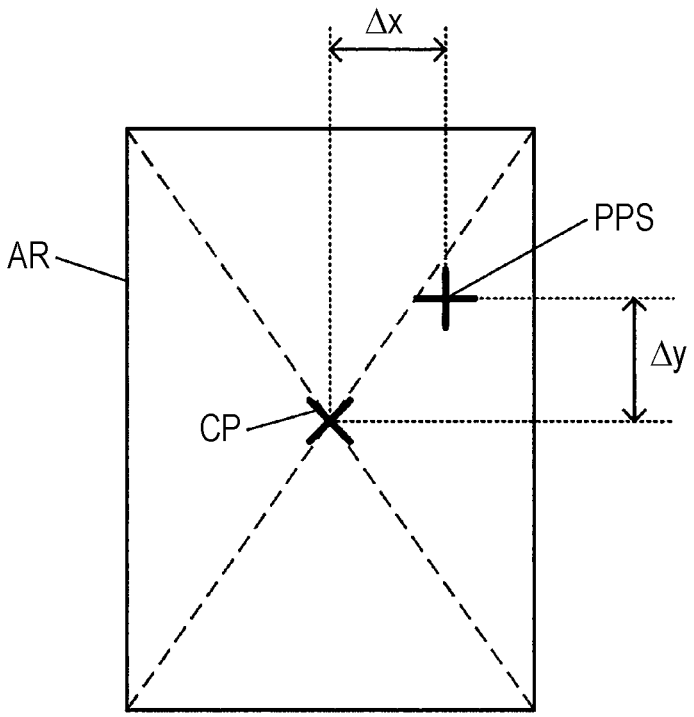
FIG. 8 illustrates an example of a position adjustment pattern.

In step S2, the printing apparatus 10 prints the position adjustment pattern PPS used for the photography area AR for the imaging apparatus 40. An example of the position adjustment pattern PPS is illustrated in FIGS. 3 and 8. Specifically, the printing apparatus 10 moves the carriage 20 to a predetermined position at which the position adjustment pattern PPS is to be printed, and prints the position adjustment pattern PPS by using the print head 22.

In step S3, the position adjustment pattern PPS, which has been printed on the print medium 2, is photographed by the imaging apparatus 40. Specifically, the printing apparatus 10 moves the carriage 20 to a position at which the printed position adjustment pattern PPS enters the photography area AR. At that position, the printing apparatus 10 causes the imaging apparatus 40 to photograph the position adjustment pattern PPS.

In step S4, the printing apparatus 10 calculates correction values ($\Delta x$, $\Delta y$) for the photography position taken by the imaging apparatus 40 from information in the position adjustment pattern PPS photographed by the imaging apparatus 40. In FIG. 8, for example, the printing apparatus 10 calculates the difference between the X coordinate at the center of the photographed position adjustment pattern PPS and the X coordinate at a reference position CP in the photography area AR, as a correction value $\Delta x$. The printing apparatus 10 also calculates the difference between the Y coordinate at the center of the photographed position adjustment pattern PPS and the Y coordinate at the reference position CP in the photography area AR, as a correction value $\Delta y$. The reference position CP is, for example, the center of the photography area AR.

In step S5, the printing apparatus 10 stores the calculated correction values ($\Delta x$, $\Delta y$) in the storage section 80.

A2 in FIG. 7 is a flow of processing in which precision in landing deviation detection is corrected according to the obtained correction value for use for position adjustment.

In step S6, the printing apparatus 10 prints the test patterns TPT1 and TPT2. Specifically, the printing apparatus 10 moves the carriage 20 to a predetermined position at which the test patterns TPT1 and TPT2 are to be printed, and prints the test patterns TPT1 and TPT2 by using all head units denoted 31 and 32. Thus, the test patterns TPT1 and TPT2, which respectively correspond to the head units 31 and 32, are printed.

In step S7, the printing apparatus 10 performs a control to transport the print medium 2 according to the correction value $\Delta y$. Specifically, the printing apparatus 10 reads out the correction value $\Delta y$ stored in the storage section 80, the correction value $\Delta y$ being the difference from the Y coordinate at the center of the photographed position adjustment pattern PPS, as a value to correct deviation of the center position in the photography area AR. The printing apparatus 10 then performs a control to transport the print medium 2 by $\Delta y$.

In step S8, the printing apparatus 10 performs a control to move the carriage 20 according to the correction value $\Delta x$. Specifically, the printing apparatus 10 reads out the correction value Δx stored in the storage section 80, the correction value Δx being the difference from the X coordinate at the center of the photographed position adjustment pattern PPS, as a value to correct deviation of the center position in the photography area AR. The printing apparatus 10 then performs a control to move the carriage 20 by Δx before the imaging apparatus 40 photographs the test patterns TPT1 and TPT2.

In step S9, the printing apparatus 10 photographs the test patterns TPT1 and TPT2 printed on the print medium 2.

In step S10, the printing apparatus 10 detects landing deviation according to an image in which the test patterns TPT1 and TPT2 are imaged. The test patterns TPT1 and TPT2 may be imaged in different images. Alternatively, the two test patterns may be imaged in the same image. The printing apparatus 10 calculates a landing deviation correction value according to the difference between the landing positions of ink from the nozzles in the head units 31 and 32 the ideal landing reference on the two-dimensional scale 47.

In step S11, the printing apparatus 10 stores the calculated landing deviation correction value in the storage section 80. When this landing deviation correction value is used in actual printing on the print medium 2, preferred print control can be performed.

Although an example in which correction of only the camera position is performed in A1 above has been described, keystone correction may be further performed for an image obtained by imaging. For example, the printing apparatus 10 prints a grid as the position adjustment pattern PPS, besides the plus mark illustrated in FIGS. 3 and 8. The printing apparatus 10 obtains a keystone correction value according to which distortion of the grid for the position adjustment pattern PPS photographed by the imaging apparatus 40 is corrected. The printing apparatus 10 performs keystone correction for the image resulting from photographing the test patterns TPT1 and TPT2, and detects landing deviation from an image obtained after keystone correction.

According to this embodiment, the processing section 70 in the printing apparatus 10 performs calibration processing on the photography area AR. Calibration processing corresponds to A1 in the processing flow described above.

Thus, since the photography area AR for the imaging apparatus 40, the photography area AR being used in detection of landing deviation, is calibrated, the two-dimensional scale 47, which is a reference in detection of landing deviation, is calibrated. That is, when error occurs in the position at which the imaging apparatus 40 is mounted, the ideal landing position defined on the two-dimensional scale 47 is shifted by an amount equal to the error. According to this embodiment, since the photography area AR is calibrated, landing deviation can be detected with respect to an appropriate ideal landing position.

3. Details of Landing Deviation Detection

Figure 9:
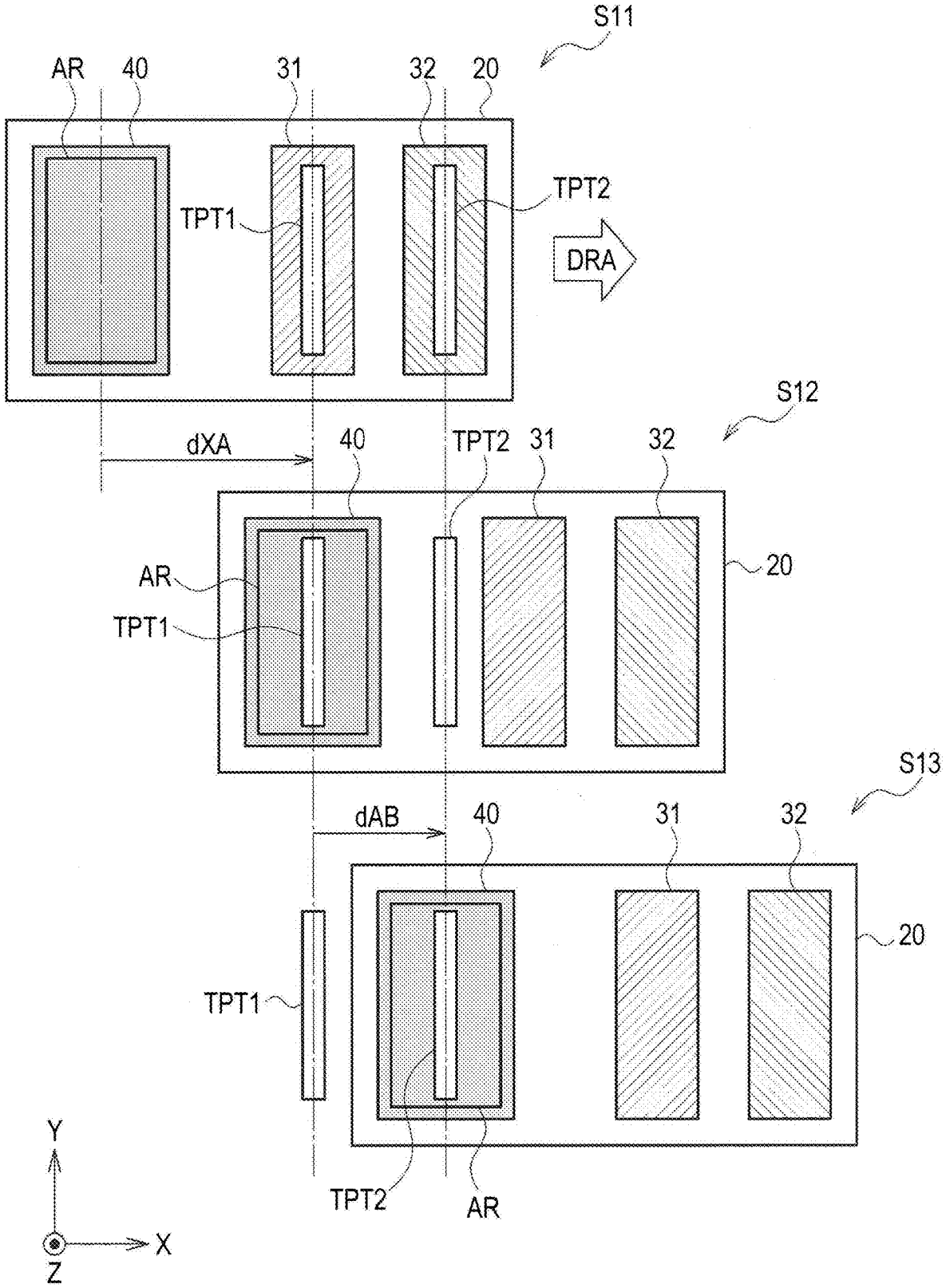
FIG. 9 illustrates a first example of a test pattern photograph method.

FIG. 9 illustrates a first example of a test pattern photograph method. In FIG. 9, movements of the carriage 20 in the main scanning direction DRA are schematically arranged vertically. However, this does not indicate that the carriage 20 moves in the Y-axis direction. The carriage 20 moves only in the main scanning direction DRA. In FIG. 9, the print medium 2 is not illustrated.

As illustrated in S11, the print control section 72 causes the head unit 31 to print the test pattern TPT1 and also causes the head unit 32 to print the test pattern TPT2 so that the test patterns TPT1 and TPT2 are concurrently printed. Ideally, the test patterns TPT1 and TPT2 are each a ruled line pattern along the Y-axis direction. That is, the test patterns TPT1 and TPT2 printed on the print medium 2 are each a row of landings of ink discharged from the relevant nozzle row. Ideally, the test patterns TPT1 and TPT2 are each a row of landings along the Y-axis direction. Although an example will be described below in which one row of landings is printed for each nozzle row as a test pattern, a plurality of rows of landings may be printed for each nozzle row as a test pattern.

As illustrated in S12, the landing deviation detection section 78 causes the imaging apparatus 40 to photograph the test pattern TPT1 at a time when the carriage 20 moves by a distance dXA. Thus, an image including the test pattern TPT1 in a central area in the photography area AR is obtained. As illustrated in S13, the landing deviation detection section 78 causes the imaging apparatus 40 to photograph the test pattern TPT2 at a time when the carriage 20 further moves by a distance dAB. Thus, an image including the test pattern TPT2 in the central area in the photography area AR is obtained. The distance dXA is a design value for the distance between the imaging apparatus 40 and the head unit 31 in the X-axis direction. The distance dAB is a design value for the distance between the head unit 31 and the head unit 32 in the X-axis direction. Specifically, the distance dXA is a design value for the distance in the X-axis direction between the center of the photography area AR and the nozzle row in the head unit 31, and the distance dAB is a design value for the distance in the X-axis direction between the nozzle row in the head unit 31 and the nozzle row in the head unit 32. These design values, which are determined at the time of design, hold when the imaging apparatus 40 and the head units 31 and 32 are ideally mounted in the carriage 20.

Figure 10:
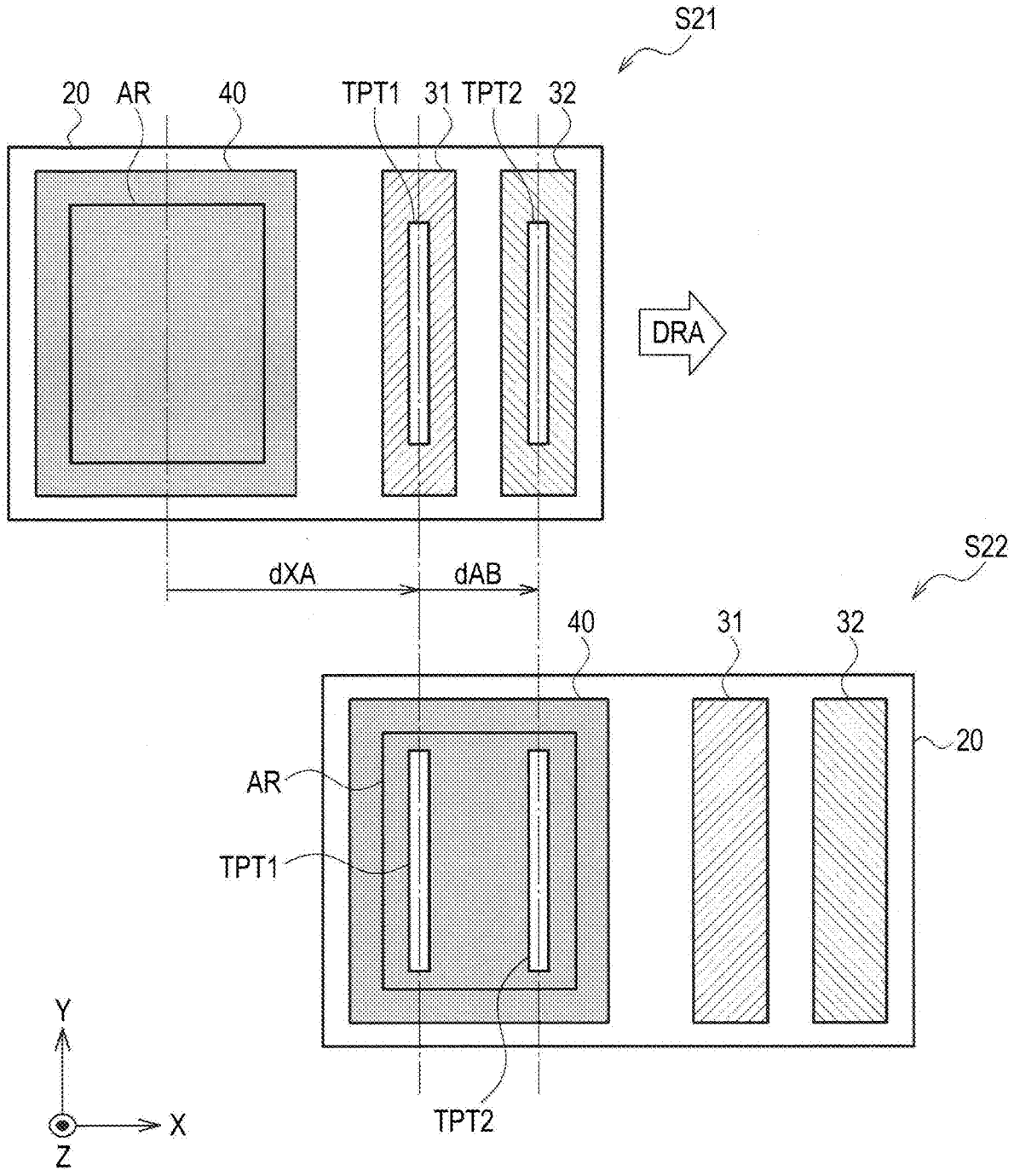
FIG. 10 illustrates a second example of the test pattern photograph method.

FIG. 10 illustrates a second example of the test pattern photograph method. In FIG. 10 as well, movements of the carriage 20 in the main scanning direction DRA are schematically arranged vertically as in FIG. 9. In FIG. 10 as well, the print medium 2 is not illustrated.

As illustrated in S21, the print control section 72 causes the head units 31 and head unit 32 to respectively print the test patterns TPT1 and TPT2 concurrently. As illustrated in S22, the landing deviation detection section 78 causes the imaging apparatus 40 to photograph the test patterns TPT1 and TPT2 at a time when the carriage 20 moves by a distance equal to dXA plus dAB/2, that is, when both the test patterns TPT1 and TPT2 enter the photography area AR. Thus, an image including both the test patterns TPT1 and TPT2 is obtained.

The landing deviation detection section 78 compares the imaged test pattern obtained in FIG. 9 or 10 with the ideal image pattern on the two-dimensional scale 47 and detects landing deviation. In this case, a first ideal image pattern has been set in correspondence to the nozzle row in the head unit 31 and a second ideal image pattern has been set in correspondence to the nozzle row in the head unit 32. The landing deviation detection section 78 compares the imaged test pattern including the test pattern TPT1 with the first ideal image pattern and detects landing deviation caused by the nozzle row in the head unit 31. The landing deviation detection section 78 also compares the imaged test pattern including the test pattern TPT2 with the second ideal image pattern and detects landing deviation caused by the nozzle row in the head unit 32.

The first ideal image pattern matches the placement of the nozzles of the nozzle row in the head unit 31. The second ideal image pattern matches the placement of the nozzles of the nozzle row in the head unit 32. That is, when the head units 31 and 32 have different nozzle placements, the first ideal image pattern and second ideal image pattern are different; when the head units 31 and 32 have the same nozzle placement, the first ideal image pattern and second ideal image pattern are identical. In the latter case, a common ideal image pattern may be stored in the storage section 80 and then may be used as the first ideal image pattern and second ideal image pattern.

According to this embodiment, by using an i-th ideal image pattern in a first ideal image pattern to an n-th ideal image pattern, which respectively correspond to a first nozzle row to an n-th nozzle row, which form a plurality of nozzle rows, the landing deviation detection section 78 detects landing deviation when an i-th nozzle row of the first nozzle row to the n-th nozzle row is used as a nozzle row to be adjusted. The letter n is an integer greater than or equal to 2. The letter i is an integer greater than or equal to 1 and smaller than or equal to n. In the example in FIG. 9 or 10, n is not equal to 2 and the nozzle rows in the head units 31 and 32 correspond to the first to n-th nozzle rows.

Thus, an ideal image pattern on the two-dimensional scale 47 is set for each of the first to n-th nozzle rows disposed in the print head 22. Accordingly, landing deviation caused by each of the first to n-th nozzle rows is detected as an absolute value on the two-dimensional scale 47 without any of the first to n-th nozzle rows being used as a reference.

In this embodiment, an example has been described in which, in FIGS. 9 and 10, the test patterns TPT1 and TPT2 are printed in areas each of which occupies substantially the whole of a vertical or horizontal portion of the photography area AR. However, the test patterns TPT1 and TPT2 may be printed in a central area in the photography area AR photographed by the imaging apparatus 40. The central area, which includes the center of the photography area AR, is narrower than the photography area AR. For example, the central area is such that its vertical width and horizontal width are a half or less of the vertical width and horizontal width of the photography area AR.

Thus, the test patterns TPT1 and TPT2 can be photographed in the central area, in the photography area AR, in which the optical performance of the lens 42 is high. This enables landing deviation to be highly precisely detected. High optical performance refers to, for example, high sharpness in the image, small aberration of the lens 42, small distortion in the image, or the like.

An example will be described below in which the test patterns TPT1 and TPT2 are photographed one at a time as illustrated in FIG. 9, after which landing deviation is detected from the imaged test patterns. Similar landing deviation detection methods are applied to these test patterns. Even when the test patterns TPT1 and TPT2 are concurrently photographed as in FIG. 10, landing deviation is detected similarly for each test pattern. However, landing deviation may be detected by detecting the distance between the two imaged test patterns as will be described later.

Figure 11:
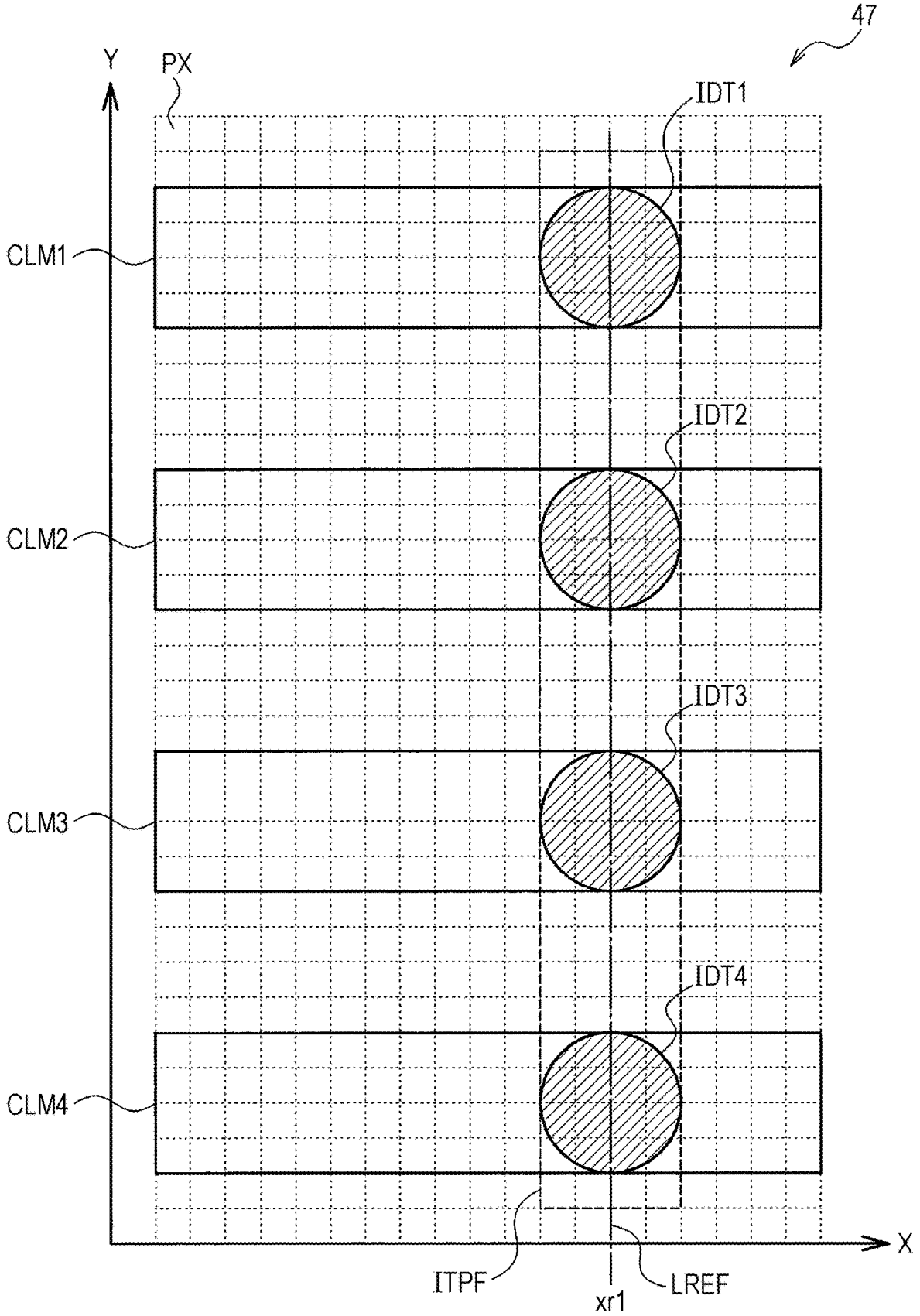
FIG. 11 illustrates an example of an ideal state in landing.

FIG. 11 illustrates an example of an ideal state of landings. In FIG. 11, one cell in the grid is equivalent to one pixel PX. ITPF is an ideal image pattern. ITPF includes ideal dots IDT1 to IDT4. One ideal dot corresponds to an ideal landing of one ink droplet discharged from one nozzle. Although, in FIG. 11, the diameter of a dot is for four pixels in the area sensor 41, this is not a limitation on the diameter of a dot.

The ideal dots IDT1 to IDT4 are aligned at equal intervals along a reference line LREF parallel to the Y axis. The X coordinate of the reference line LREF is xr1. This reference line LREF is used as a reference in detection of landing deviation to detect the amount of deviation between an actual landing and the reference line LREF in the X-axis direction as the number of pixels.

A column area CLM1 is set in correspondence to a column occupied by the ideal dot IDT1 in the pixel array in the area sensor 41. Similarly, column areas CLM2 to CLM4 are respectively set in correspondence to the ideal dots IDT2 to IDT4. The width of the column areas CLM1 to CLM4 in the X-axis direction is, for example, the width of the pixel array, but may be a predetermined width equivalent to the maximum value of landing deviation. By using these column areas CLM1 to CLM4, it is decided that a dot in the imaged test pattern corresponds to which nozzle, that is, which of the ideal dots IDT1 to IDT4.

Image data of the ideal dots IDT1 to IDT4, for example, is stored in the storage section 80 as the ideal image pattern. In this case, the landing deviation detection section 78 reads out the image data of the ideal dots IDT1 to IDT4 and obtains the X coordinate xr1 of the reference line LREF and the column areas CLM1 to CLM4 from the read-out image data. Alternatively, the X coordinate xr1 of the reference line LREF and information that specifies the column areas CLM1 to CLM4 may be stored in the storage section 80. In this case, the landing deviation detection section 78 reads out, from the storage section 80, the X coordinate xr1 of the reference line LREF and information that specifies the column areas CLM1 to CLM4.

Figure 12:
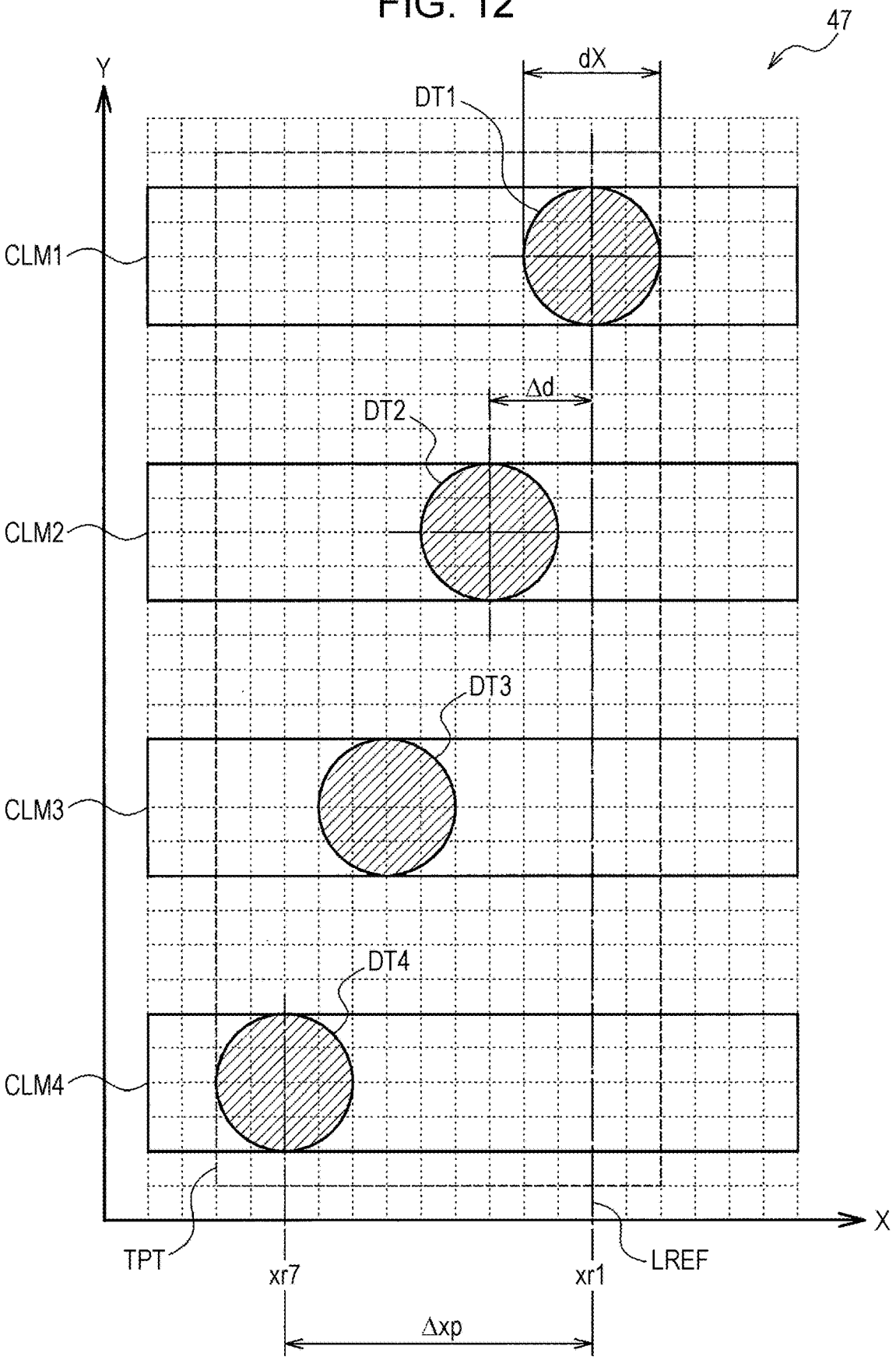
FIG. 12 illustrates an example of actual landing.

FIG. 12 illustrates an example of actual landings. In FIG. 12, one cell in the grid is equivalent to one pixel PX. TPT is an imaged test pattern resulting from imaging an actually printed test pattern. TPT includes imaged dots DT1 to DT4. One imaged dot corresponds to an actual landing of one ink droplet discharged from one nozzle.

The landing deviation detection section 78 decides the imaged dot DT1 present in the column area CLM1 as an imaged dot corresponding to the ideal dot IDT1. Similarly, the landing deviation detection section 78 decides the imaged dost DT2 to DT4 present in the column areas CLM2 to CLM4 as imaged dots corresponding to the ideal dots IDT2 to ID4, respectively.

The landing deviation detection section 78 detects the X coordinates of the centers of the imaged dots DT1 and DT4 corresponding to the nozzles at both ends of the nozzle row. It will be assumed that the X coordinate of the center of the imaged dot DT1 is xr1 and the X coordinate of the center of the imaged dot DT4 is xr7. It will be also assumed that Δxp is equal to xr7 minus xr1 and the number of nozzles in the nozzle row is an integer m larger than or equal to 2. Then, a landing deviation amount Δd per dot in the imaged test pattern TPT is represented as in equation (1) below. Δxp and Δd are represented as the number of pixels. For example, the distance of one pixel is 1 and the distance of 0.5 pixel is 0.5.

$$\Delta d=\Delta xp/(m-1) \tag{1}$$

When j is an integer greater than or equal to 1 and smaller than or equal to m, a landing deviation amount xdj for a j-th imaged dot in the X-axis direction with respect to the reference line LREF is represented as in equation (2) below.

$$xdj=(j-1)\times\Delta d \tag{2}$$

When the dot pitch on the two-dimensional scale 47 is dx, a deviation amount Δd' that indicates a dot pitch to which the landing deviation amount Δd per dot is equivalent is represented as in equation (3) below and a deviation amount xdj' that indicates a dot pitch to which the landing deviation amount xdj is equivalent is represented as in equation (4) below. The dot pitch dx is a value indicating the number of pixels, on the two-dimensional scale 47, that is equivalent to the dot pitch of an actual distance on the print medium 2. The dot pitch dx is determined by the optical magnification ratio of the imaging apparatus 40. In the example in FIG. 12, Δd is for three pixels and dx is for four pixels per dot, so Δd' is for 0.75 dot.

$$\Delta d' = \Delta d / dx \tag{3}$$

$$xdj' = (j-1) \times \Delta d' \tag{4}$$

In FIG. 12, the X coordinate at the center of the imaged dot DT1 is xr1, which is the same as the X coordinate of the reference line LREF. However, this is not a limitation. When the X coordinate at the center of the imaged dot DT1 is xr2, Δxp in equation (1) above is xr7 minus xr2 and xdj is represented as in equation (5) below.

$$xdj = (xr2 - xr1) + (j-1) \times Ad \tag{5}$$

According to this embodiment, the test pattern is a ruled line test pattern in which ruled lines parallel to nozzle rows are printed. The landing deviation detection section 78 detects, as the landing deviation amount xdj for the nozzle row to be adjusted, the amount of deviation between the reference line LREF, on the two-dimensional scale 47, which corresponds to a particular row in the area sensor 41, and the ruled line test pattern imaged as the imaged test pattern TPT.

Thus, it is possible to detect the landing deviation amount xdj of each dot in the X-axis direction with respect to the X coordinate xr1 of a particular row corresponding to the reference line LREF. When the reference line LREF is used, a comparison between dots does not need to be made. Therefore, it is also possible to detect landing deviation amount xdj only from a difference between X coordinates, simplifying processing.

In this embodiment, the landing deviation detection section 78 detects, as the number of pixels in the area sensor 41, the absolute value of the amount of deviation between the ruled line test pattern and the reference line LREF on the two-dimensional scale 47. This is equivalent to saying that, in this embodiment, Δxp or Δd is obtained as the number of pixels.

Thus, landing deviation amount xdj of each nozzle can be detected by detecting, on the image, the number of pixels between the reference line LREF and the relevant landing. Since the two-dimensional scale 47 and an actual distance on the print medium 2 are mutually associated by the optical magnification ratio of the imaging apparatus 40, the landing deviation amount xdj detected as the number of pixels can be converted to the deviation amount xdj' represented by the number of dots, as described by using equations (3) and (4) above. When image shift correction or discharge timing correction is performed according to this deviation amount xdj' represented by the number of dots, landing deviation can be corrected.

In this embodiment, the reference line LREF is parallel to the Y-axis direction. The landing deviation detection section 78 detects, as the landing deviation amount xdj, the amount of deviation in the X-axis direction between the reference line LREF and the landing position, on the ruled line test pattern, of a nozzle in the nozzle row to be adjusted.

Thus, it is possible to detect the landing deviation amount xdj for each of a plurality of nozzles included in the nozzle row to be adjusted. This enables image shift correction or discharge timing correction to be appropriately performed, and image unevenness due to landing deviation can thereby be corrected.

When the two test patterns TPT1 and TPT2 are imaged concurrently as illustrated in FIG. 10, the distance between the test patterns TPT1 and TPT2 may be detected. That is, the landing deviation detection section 78 detects a distance dAB' between the test patterns TPT1 and TPT2 from the imaged test pattern and detects the difference between the distance dAB' and the design distance dAB, which is an ideal value, as the amount of landing deviation. In this case, relative attachment error in the head units 31 and 32 is detected by absolutely using the two-dimensional scale 47, without using any one of the head units 31 and 32 as a reference. That is, even when any one of the head units 31 and 32 is replaced, relative attachment error in the head units 31 and 32 is only detected.

Figure 13:
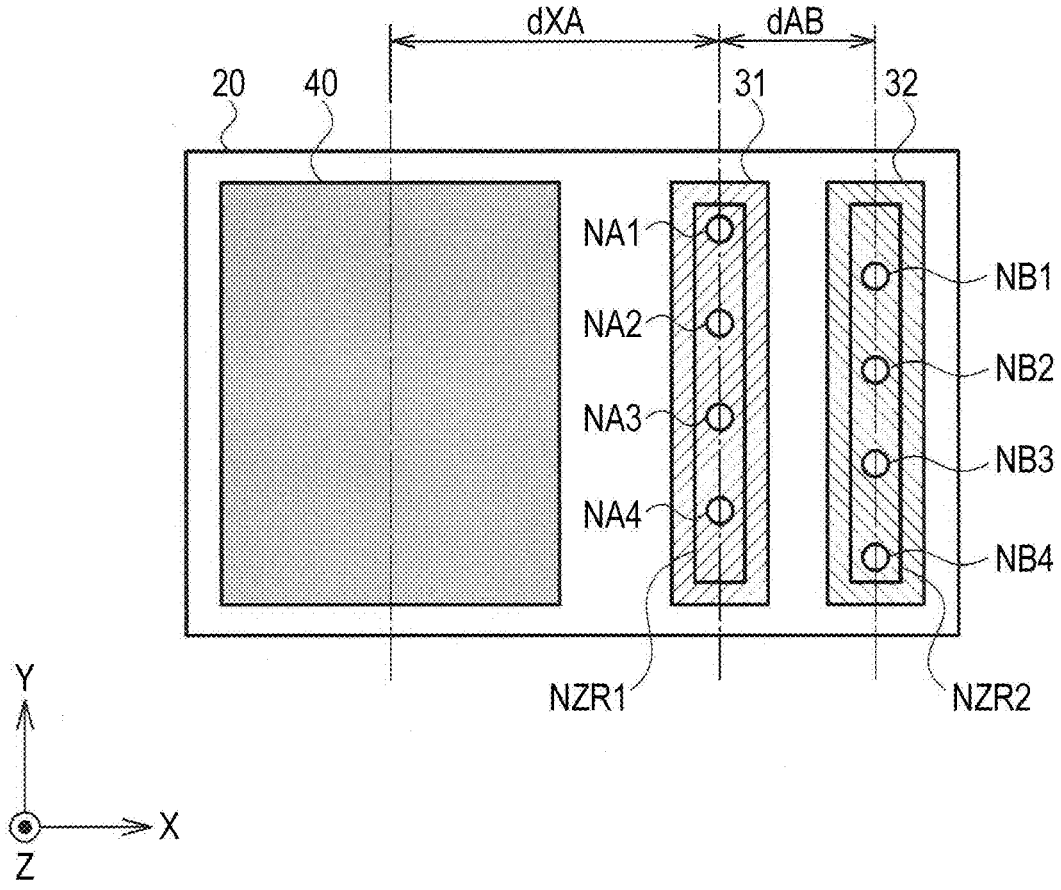
FIG. 13 illustrates a variation of landing deviation detection.
Figure 14:
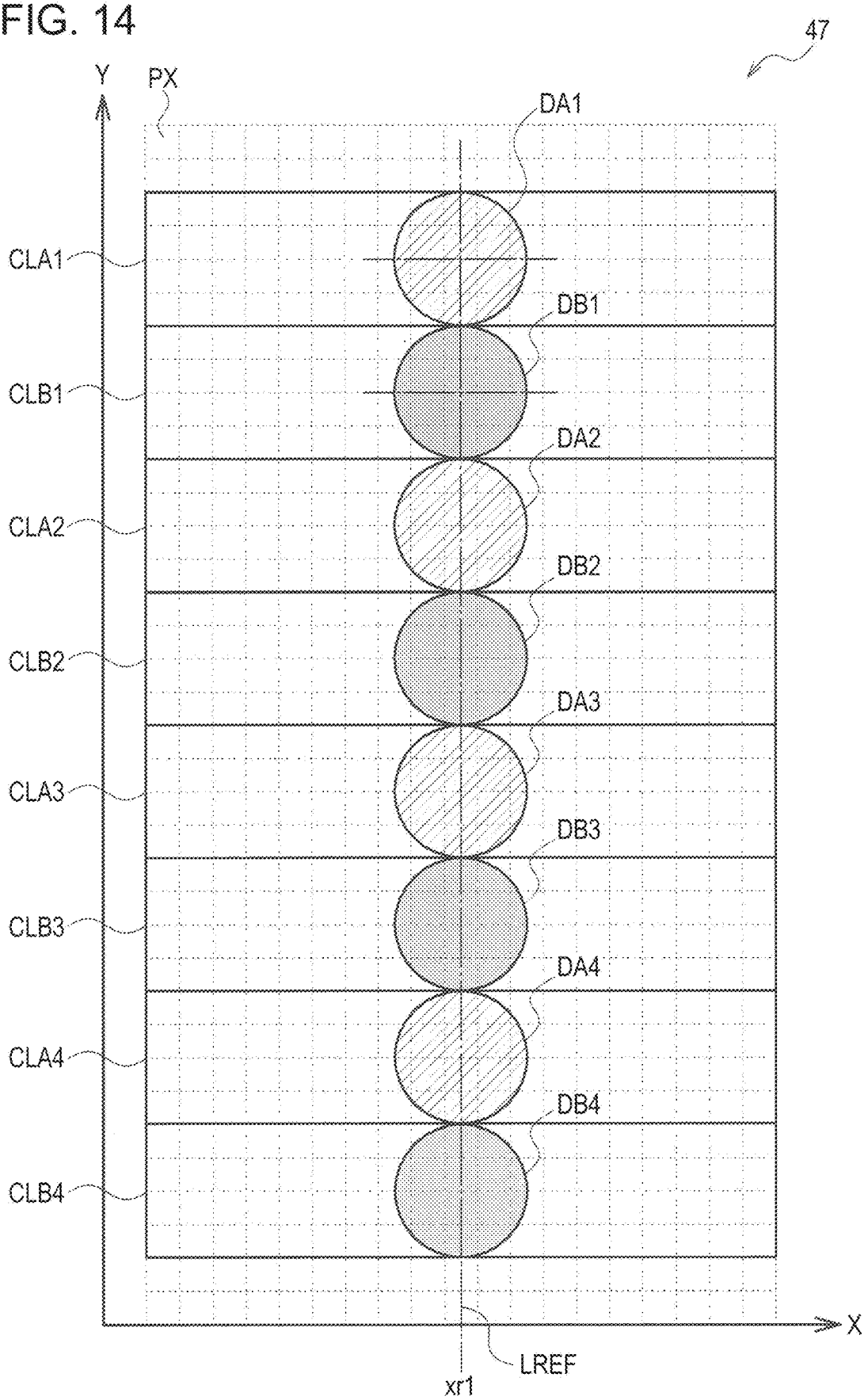
FIG. 14 illustrates another variation of landing deviation detection.

FIGS. 13 and 14 illustrate variations of landing deviation detection. In FIG. 13, nozzles NA1 to NA4 provided in the nozzle row NZR1 in the head unit 31 and nozzles NB1 to NB4 provided in the nozzle row NZR2 in the head unit 32 are placed so as to be alternately arranged in the Y-axis direction. That is, when the nozzles NB1 to NB4, for example, are moved in the X-axis direction so that the nozzles NA1 to NA4 and nozzles NB1 to NB4 are aligned along the Y-axis direction, the nozzles NA1, NB1, NA2, NB2, . . . , NA4, and NB4 are aligned at equal intervals.

In the nozzle arrangement in FIG. 13, an ideal image pattern illustrated in FIG. 14 can be used. The ideal image pattern in FIG. 14 includes ideal dots DA1 to DA4 corresponding to the nozzles NA1 to NA4 and ideal dots DB1 to DB4 corresponding to the nozzles NB1 to NB4. In the ideal image pattern, DA1, DB1, DA2, DB2, . . . , DA4, and DB4 are aligned at equal intervals along the reference line LREF parallel to the Y axis.

When the print control section 72 causes the head units 31 and 32 to print test patterns, the print control section 72 performs a control so that the head units 31 and 32 print ruled line test patterns on the same straight line parallel to the Y-axis direction. That is, the print control section 72 causes the head unit 32 to print a ruled line test pattern, after which the print control section 72 causes the head unit 31 to print another ruled line test pattern at a time when the carriage 20 has moved by dAB. The landing deviation detection section 78 causes the imaging apparatus 40 to image the test patterns printed on the print medium 2, and acquires the imaged test pattern. The landing deviation detection section 78 then compares the imaged test pattern with the ideal image pattern and detects landing deviation caused by each nozzle in the head units 31 and 32.

The printing apparatus described above in this embodiment includes a print head, an imaging apparatus, a carriage, and a processing section. The print head has a plurality of nozzle rows, each of which is composed of a plurality of nozzles. The imaging apparatus includes an area sensor and a lens. The print head and imaging apparatus are mounted in the carriage. The processing section prints a test pattern by using the print head, causes the imaging apparatus to image the test pattern, acquires the imaged test pattern, and according to the imaged test pattern, detects landing deviation of ink discharged from the plurality of nozzles. The area sensor has a matrix of a plurality of pixels placed in a row direction and a column direction. The imaging apparatus is disposed in the carriage so that the row direction of the area sensor and the direction in which the plurality of nozzles constituting each nozzle row are placed become parallel. A scale in which the row direction of the area sensor is the Y-axis direction and the column direction of the area sensor is the X-axis direction will be taken as a two-dimensional scale, which is a virtual scale. The processing section causes ink to be discharged from a nozzle row to be adjusted, which is one of the plurality of nozzle rows, to print the test pattern. By using the two-dimensional scale as a reference in detection of landing deviation, the processing section detects the landing deviation caused by the nozzle row to be adjusted, according to the imaged test pattern.

Thus, the two-dimensional scale, the Y axis and X axis of which are stipulated by the row direction and column direction of the area sensor, becomes a reference in landing deviation of ink. That is, since a reference other than the plurality of nozzle rows included in the print head is used, the plurality of nozzle rows are equally handled in landing deviation detection. Therefore, even when a head unit in which any one of the plurality of nozzle rows is mounted is replaced, the two-dimensional scale can still be used as a reference to detect landing deviation caused by each nozzle row.

In this embodiment, to detect landing deviation, the processing section may detect the landing deviation by comparing the imaged test pattern with an ideal image pattern for landing positions, on the two-dimensional scale, of the nozzle row to be adjusted.

Thus, when the imaged test pattern is compared with the ideal image pattern defined on the two-dimensional scale, it is possible to detect landing deviation caused by each nozzle row with reference to the two-dimensional scale.

In this embodiment, by using an i-th ideal image pattern (i is an integer greater than or equal to 1 and smaller than or equal to n) in a first ideal image pattern to an n-th ideal image pattern (n is an integer greater than or equal to 2), which respectively correspond to a first nozzle row to an n-th nozzle row, which form the plurality of nozzle rows, the processing section may detect the landing deviation when an i-th nozzle row of the first nozzle row to n-th nozzle row is used as the nozzle row to be adjusted.

Thus, an ideal image pattern on the two-dimensional scale is set for each of the first to n-th nozzle rows disposed in the print head. Accordingly, landing deviation caused by each of the first to n-th nozzle rows is detected as an absolute value on the two-dimensional scale without any one of the first to n-th nozzle rows being used as a reference.

In this embodiment, the area sensor may be a sensor that reads out all of a plurality of pixel data items in the row direction at once and outputs the read-out pixel data.

In a rolling shutter method, rows are read out at different times. When the imaging apparatus and a subject relatively move, therefore, rolling shutter distortion may occur. In this embodiment, the imaging apparatus is disposed in the carriage so that the row direction of the area sensor, by which all of a plurality of pixel data items are read out at once, and the direction in which a plurality of nozzles constituting each nozzle row are placed become parallel. Thus, since the row direction of the area sensor is orthogonal to the main scanning direction, the effect of rolling shutter distortion is less likely to occur when landings from the nozzle rows are imaged.

In this embodiment, the test pattern may be a ruled line test pattern in which ruled lines parallel to nozzle rows are printed. The processing section may detect, as the amount of landing deviation caused by the nozzle row to be adjusted, the amount of deviation between a reference line, on the two-dimensional scale, which corresponds to a particular row in the area sensor and the ruled line test pattern imaged as the imaged test pattern.

Thus, it is possible to detect the amount of landing deviation in each dot in the X-axis direction with respect to the X coordinate of a particular row corresponding to the reference line. When the reference line is used, a comparison between dots does not need to be made. The amount of landing deviation can be detected only from a difference between X coordinates, simplifying processing.

In this embodiment, the processing section may detect, as the number of pixels in the area sensor, the absolute value of the amount of deviation between the ruled line test pattern and the reference line on the two-dimensional scale.

Thus, the amount of landing deviation can be detected for each nozzle by detecting, on the image, the number of pixels between the reference line and the relevant landing. Since the two-dimensional scale and an actual distance on the print medium are mutually associated by the optical magnification ratio of the imaging apparatus, the amount of landing deviation detected as the number of pixels can be converted to the amount of deviation represented by the number of dots. Accordingly, a two-dimensional scale can be used as a scale for the amount of landing deviation.

In this embodiment, the reference line may be parallel to the Y-axis direction. The processing section may detect, as the amount of landing deviation, the amount of deviation in the X-axis direction between the reference line and the landing position, on the ruled line test pattern, of a nozzle in the nozzle row to be adjusted.

Thus, it is possible to detect the amount of landing deviation caused by each of a plurality of nozzles included in the nozzle row to be adjusted. This enables image shift correction or discharge timing correction to be appropriately performed, and image unevenness due to landing deviation can thereby be corrected.

In this embodiment, the test pattern may be printed in a central area in a photography area photographed by the imaging apparatus.

Thus, the test pattern can be photographed in the central area, of the photography area, in which the optical performance of the lens is high. This enables landing deviation to be highly precisely detected.

In this embodiment, the processing section may perform calibration processing on the photography area.

When error occurs in the position at which the imaging apparatus is mounted, the ideal landing position defined on the two-dimensional scale is shifted by an amount equal to the error. According to this embodiment, since the photography area for the imaging apparatus, the photography area being used in detection of landing deviation, is calibrated, the two-dimensional scale, which is a reference in detection of landing deviation, is calibrated. Thus, landing deviation can be detected with respect to an appropriate ideal landing position.

An adjustment method in this embodiment adjusts landing deviation in a printing apparatus that includes a print head that has a plurality of nozzle rows, each of which is composed of a plurality of nozzles, an imaging apparatus that includes an area sensor and a lens, and a carriage in which the print head and imaging apparatus are mounted. The adjustment method prints a test pattern by using the print head to cause ink to be discharged from a nozzle row to be adjusted, the nozzle row being included in the plurality of nozzle rows. The adjustment method causes the imaging apparatus, in which the area sensor has a matrix of a plurality of pixels placed in a row direction and a column direction and which is disposed so that the row direction of the area sensor and the direction in which the plurality of nozzles constituting each nozzle row are placed become parallel, to image the test pattern and acquire the imaged test pattern. By using a virtual two-dimensional scale as a reference in detection of landing deviation, the virtual two-dimensional scale being a scale in which the row direction of the area sensor is a Y-axis direction and the column direction of the area sensor is an X-axis direction, the adjustment method detects landing deviation of ink discharged from the plurality of nozzles in the nozzle row to be adjusted, according to the imaged test pattern. The adjustment method adjusts the landing deviation according to the landing deviation.

So far, this embodiment has been described above in detail. However, it will be understood by those skilled in the art that many variations are possible without substantively departing from the novel items and effects in the present disclosure. Therefore, these variations are all included in the range of the present disclosure. For example, when a term is described at least once in the specification or the drawings together with a different term that has a broader sense than the term or is synonymous with the term, the term can be replaced with the different term at any portions in the specification or the drawings. All combinations of this embodiment and its variations are also included in the range of the present disclosure. Various variations can also be practiced for the structures, operations, and the like of the printing apparatus and the like and for the method of adjusting the printing apparatus, without being limited to those described in this embodiment.

What is claimed is:

1. A printing apparatus comprising:

a print head that has a plurality of nozzle rows, each of which is composed of a plurality of nozzles;

an imaging apparatus that includes an area sensor and a lens;

a carriage in which the print head and the imaging apparatus are mounted; and a processing section that prints a test pattern by using the print head, causes the imaging apparatus to image the test pattern, acquires an imaged test pattern, and according to the imaged test pattern, detects landing deviation of ink discharged from the plurality of nozzles; wherein the area sensor has a matrix of a plurality of pixels placed in a row direction and a column direction, the imaging apparatus is disposed in the carriage so that the row direction of the area sensor and a direction in which the plurality of nozzles constituting each nozzle row are placed become parallel, and the processing section causes ink to be discharged from a nozzle row to be adjusted, the nozzle row being included in the plurality of nozzles rows, to print the test pattern, after which by using a virtual two-dimensional scale as a reference in detection of landing deviation, the virtual two-dimensional scale being a scale in which the row direction of the area sensor is a Y-axis direction and the column direction of the area sensor is an X-axis direction, the processing section detects the landing deviation caused by the nozzle row to be adjusted, according to the imaged test pattern, wherein:

the test pattern is a ruled line test pattern in which a ruled line parallel to each nozzle row is printed; and the processing section detects, as an amount of landing deviation caused by the nozzle row to be adjusted, an amount of deviation between a reference line on the virtual two-dimensional scale, the reference line corresponding to a particular row in the area sensor, and the ruled line test pattern imaged as the imaged test pattern.

2. The printing apparatus according to claim 1, wherein the processing section detects the landing deviation by comparing the imaged test pattern with an ideal image pattern for a landing position of the nozzle row to be adjusted, the landing position being on the virtual two-dimensional scale.

3. The printing apparatus according to claim 2, wherein by using an i-th ideal image pattern in a first ideal image pattern to an n-th ideal image pattern, which respectively correspond to a first nozzle row to an n-th nozzle row, which form the plurality of nozzle rows, the processing section detects the landing deviation when an i-th nozzle row of the first nozzle row to the n-th nozzle row is used as the nozzle row to be adjusted, where n is an integer greater than or equal to 2 and i is an integer greater than or equal to 1 and smaller than or equal to n.

4. The printing apparatus according to claim 1, wherein the area sensor is a sensor that reads out all of a plurality of pixel data items in the row direction at once and outputs read-out pixel data.

5. The printing apparatus according to claim 1, wherein the processing section detects, as the number of pixels in the area sensor, an absolute value of the amount of deviation between the ruled line test pattern and the reference line on the two-dimensional scale.

6. The printing apparatus according to claim 1, wherein:

the reference line is parallel to the Y-axis direction; and the processing section detects, as the amount of landing deviation, an amount of deviation in the X-axis direction between the reference line and a landing position of a nozzle in the nozzle row to be adjusted, the landing position being on the ruled line test pattern.

7. The printing apparatus according to claim 1, wherein the test pattern is printed in a central area in a photography area photographed by the imaging apparatus.

8. The printing apparatus according to claim 7, wherein the processing section performs calibration processing on the photography area.

9. An adjustment method of adjusting landing deviation in a printing apparatus that includes a print head that has a plurality of nozzle rows, each of which is composed of a plurality of nozzles, an imaging apparatus that includes an area sensor and a lens, and a carriage in which the print head and the imaging apparatus are mounted, the method comprising:

printing a test pattern by using the print head to cause ink to be discharged from a nozzle row to be adjusted, the nozzle row being included in the plurality of nozzle rows;

causing the imaging apparatus, in which the area sensor has a matrix of a plurality of pixels placed in a row direction and a column direction and which is disposed so that the row direction of the area sensor and a direction in which the plurality of nozzles constituting each nozzle row are placed become parallel, to image the test pattern and acquire the imaged test pattern;

detecting, by using a virtual two-dimensional scale as a reference in detection of landing deviation, the virtual two-dimensional scale being a scale in which the row direction of the area sensor is a Y-axis direction and the column direction of the area sensor is an X-axis direction, the landing deviation of ink discharged from the plurality of nozzles in the nozzle row to be adjusted, according to the imaged test pattern; and adjusting the landing deviation according to the landing deviation wherein:

the test pattern is a ruled line test pattern in which a ruled line parallel to each nozzle row is printed; and the processing section detects, as an amount of landing deviation caused by the nozzle row to be adjusted, an amount of deviation between a reference line on the virtual two-dimensional scale, the reference line corresponding to a particular row in the area sensor, and the ruled line test pattern imaged as the imaged test pattern.

* * * * *